US005466566A

United States Patent [19]

Tashiro et al.

[11] Patent Number: 5,466,566

[45] Date of Patent: Nov. 14, 1995

[54] SILVER HALIDE COLOR PHOTOGRAPHIC MATERIAL

[75] Inventors: Mamoru Tashiro; Seiji Ichijima, both of Kanagawa, Japan

[73] Assignee: Fuji Photo Film Co., Ltd., Kanagawa, Japan

[21] Appl. No.: 94,958

[22] Filed: Jul. 23, 1993

[30] Foreign Application Priority Data

Jul. 23, 1992 [JP] Japan ..... 4-216606

[51] Int. Cl.[6] ..... G03C 1/46

[52] U.S. Cl. ..... 430/505; 430/503; 430/504; 430/506; 430/567; 430/555; 430/557; 430/558; 430/958

[58] Field of Search ..... 430/504, 506, 430/503, 505, 567, 555, 557, 558, 958

[56] References Cited

U.S. PATENT DOCUMENTS

| | | | |
|---|---|---|---|
| 4,647,527 | 3/1987 | Ikenoue et al. | 430/506 |
| 4,711,837 | 12/1987 | Ichijima et al. | 430/958 |
| 4,840,884 | 6/1989 | Mooberry et al. | 430/958 |
| 4,842,985 | 6/1989 | Ono et al. | 430/506 |
| 5,268,262 | 12/1993 | Shibahara et al. | 430/506 |

FOREIGN PATENT DOCUMENTS 0492443 7/1992 European Pat. Off. .

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide color photographic material comprises at least one red-sensitive layer, at least one green-sensitive layer and at least one blue-sensitive layer on a support, in which (1) the blue-sensitive layer contains a magenta colored or cyan colored yellow coupler and contains an emulsion of tabular grains having a mean aspect ratio of 3.0 or more, (2) the green-sensitive layer contains a cyan colored magenta coupler and contains an emulsion of tabular grains having a mean aspect ratio of 3.0 or more, or (3) the blue-sensitive layer and/or the green-sensitive layer contain(s) a magenta colored or cyan colored colorless coupler and contain(s) an emulsion of tabular grains having a mean aspect ratio of 3.0 or more. The material has excellent color reproducibility and gives a color image having good sharpness and storage stability.

5 Claims, No Drawings

SILVER HALIDE COLOR PHOTOGRAPHIC MATERIAL

FIELD OF THE INVENTION

The present invention relates to a silver halide color photographic material and, more precisely, to a silver halide color photographic material having excellent color reproducibility and sharpness and having improved color image stability during storage.

BACKGROUND OF THE INVENTION

Color negative photographic materials are widely utilized in the world, and there are many kinds of color negative materials having different properties in accordance with their intended use. One example of general use of such a material is a picture-taking color negative photographic material which is finally converted into a color positive photographic material, such as a color printing paper, a color transparency or the like to be viewed by human eyes. Another example of use of such a material is conversion of a formed positive image (for example, a color transparency) into a different positive image (for example, a color printing paper) for its final view. There is a color negative photographic material which can be used for such conversion, and the intermediate negative material to be used for positive(original)-negative-positive conversion is known as a color inter-negative.

On the other hand, the intermediate negative material to be used for negative(original)-positive-negative or negative(original)-positive-negative-positive-negative conversion has widely been used as a color-intermediate film in the movie industry. It is absolutely necessary that these types of intermediate photographic materials faithfully reproduce original positives or original negatives, and for attaining this purpose, various improvements and studies of photographic materials have heretofore been made but the improvements are still insufficient. Naturally, from the viewpoint of reproduction of originals, general picture-taking color photographic materials are also needed to be improved further.

As one means of improving color reproducibility and sharpness of photographic materials, for example, use of so-called DIR compounds such as those described in JP-A 54-145135, 56-114946 and 57-151944 is well known. (The term "JP-A" as used herein means an "unexamined published Japanese patent application".) As another more recent means of improving color reproducibility and sharpness, the use of couplers capable of releasing a development inhibiting compound via two timing groups such as the couplers described in JP-A 60-218645, 61-156127, 1-280755, JP-A-63-37346 corresponding to U.S. Pat. No. 4,861,701 and European Patent Laid-Open Nos. 348,139, 354,532 and 403,019 is also known. Use of such timing DIR couplers is effective for improving the interlayer effect and the edge effect to improve the color reproducibility and sharpness of photographic materials to a certain degree in many cases. However, these timing DIR couplers still have various inconvenient drawbacks. The interlayer effect and the edge effect are not satisfactory if the amount of the development inhibiting compound to be released from the timing DIR couplers is not sufficient to inhibit development. Also, the inhibiting effect of the timing DIR couplers is negligible if the light-sensitive layer to be inhibited by the released compound has not been developed to some degree. In addition, if the developing activity of the light-sensitive silver halides is high (or if the light-sensitive silver halides are developed rapidly), the inhibiting effect of the above-mentioned DIR couplers and timing DIR couplers is noticeably retarded so that the couplers can hardly attain the intended result.

In order to improve the color reproducibility of photographic materials, a masking technology using colored couplers has been proposed, but the use of such couplers is naturally limited because coloration of the colored couplers themselves is used. On the other hand, not only the above-mentioned intermediate photographic materials but also general color photographic materials are stored after development and then may be used to make prints after several decades storage, which is a long time. After such long storage, the conventional photographic materials often encounter problems in that the color image formed has become "thin" and has lost its contrast or has been decolored. Persons involved in the technical field of photographic materials have studied and investigated these problems for a long period of time in attempts to overcome them but, until now, no satisfactory solutions have been found.

SUMMARY OF THE INVENTION

A first object of the present invention is to provide a photographic material having improved color reproducibility and sharpness.

A second object of the invention is to provide a photographic material having excellent color image stability during storage.

These objects have been attained by the following photographic materials (1) to (3):

(1) A silver halide color photographic material having at least one cyan-coloring coupler-containing red-sensitive silver halide emulsion layer, at least one magenta-coloring coupler-containing green-sensitive silver halide emulsion layer and at least one yellow-coloring coupler-containing blue-sensitive silver halide emulsion layer on a support, in which the blue-sensitive silver halide emulsion layer contains a colored coupler of the following general formula (1) and contains an emulsion of tabular silver halide grains having a mean aspect ratio of 3.0 or more:

$$A_1—(L)n—DY_1 \quad (1)$$

where $A_1$ represents a yellow coupler group;

L represents a timing group;

n represents 0 or 1; and $DY_1$ represents a magenta dye group or a cyan dye group.

(2) A silver halide color photographic material having at least one cyan-coloring coupler-containing red-sensitive silver halide emulsion layer, at least one magenta-coloring coupler-containing green-sensitive silver halide emulsion layer and at least one yellow-coloring coupler-containing blue-sensitive silver halide emulsion layer on a support, in which the green-sensitive silver halide emulsion layer contains a colored coupler of the following general formula (2) and contains an emulsion of tabular silver halide grains having a mean aspect ratio of 3.0 or more:

$$A_2—(L)n—DY_2 \quad (2)$$

where $A_2$ represents a magenta coupler group;

L represents a timing group;

n represents 0 or 1; and $DY_2$ represents a cyan dye group.

(3) A silver halide color photographic material having at least one cyan-coloring coupler-containing red-sensitive silver halide emulsion layer, at least one magenta-coloring coupler-containing green-sensitive silver halide emulsion layer and at least one yellow-coloring coupler-containing blue-sensitive silver halide emulsion layer on a support, in which the blue-sensitive silver halide emulsion layer and/or the green-sensitive silver halide emulsion layer contain(s) a colored coupler of the following general formula (3) and contain(s) an emulsion of tabular silver halide grains having a mean aspect ratio of 3.0 or more:

$$A_3—(L)n—DY_1 \quad (3)$$

where $A_3$ represents a coupler group which substantially does not leave a dye in the photographic material;

L represents a timing group;

n represents 0 or 1; and $DY_1$ represents a magenta dye group or a cyan dye group.

The present invention provides a silver halide photographic material yielding a sharp photographic image free from color turbidity. The storage stability of the image to be formed by processing the material is good.

DETAILED DESCRIPTION OF THE INVENTION

The colored couplers for use in the present invention are represented by the following general formulae (1), (2) and (3):

$$A_1—(L)n—DY_1 \quad (1)$$

$$A_2—(L)n—DY_2 \quad (2)$$

$$A_3—(L)n—DY_1 \quad (3)$$

where $A_1$ represents a yellow coupler group;

$A_2$ represents a magenta coupler group;

$A_3$ represents a coupler group which substantially does not leave a dye in the photographic material;

L represents a timing group;

n represents 0 or 1;

$DY_1$ represents a magenta dye group or a cyan dye group; and $DY_2$ represents a cyan dye group.

The compounds of formulae (1), (2) and (3) are described below in detail.

Examples of the yellow coupler group represented by $A_1$ include pivaloylacetanilides, benzoylacetanilides, malondiesters, malondiamides, dibenzoylmethanes, benzothiazolylacetamides, malonester monoamides, triazolylacetamides, benzimidazolylacetamides and cycloalkanoylacetamides. Examples of the yellow coupler group representedly $A_1$ also include the coupler groups described in U.S. Pat. Nos. 5,021,332 and 5,021,330 and European Patent 421,221A.

Examples of the magenta coupler group represented by $A_2$ include 5-pyrazolones, pyrazolobenzimidazoles, pyrazolotriazoles, pyrazoloimidazoles and cyanoacetophenones.

Examples of the coupler group substantially not leaving a dye in photographic material represented by $A_3$ include a non-color forming coupler group the dye derived from which is colorless in photographic material and a coupler group the dye derived from which is dissolvable from photographic material so as not to contribute to image formation and, for example, indanones and acetophenones and also dissolving coupler groups such as those described in U.S. Pat. Nos. 4,482,629 and 5,026,628 and European Patents 443,530A and 444,501A.

As the coupler group represented by of $A_1$, the groups of the following general formulae (Cp-1) and (Cp-2) are preferred. As the coupler groups represented by $A_2$, the groups of the following general formulae (Cp-3), (Cp-4) and (Cp-5) are preferred. As the coupler group represented by $A_3$, the groups of the following general formulae (Cp-9) and (Cp-10) and also the groups of formulae (Cp-1) to (Cp-10) having an alkali-soluble group are preferred. An alkali-soluble group as referred to herein means a dissociating group such as a carboxyl group, a sulfo group or the like. These couplers are preferred as having an especially high coupling rate.

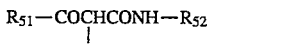
(Cp-1)

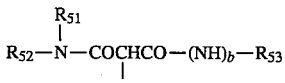
(Cp-2)

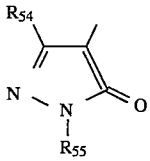
(Cp-3)

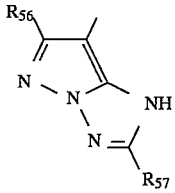
(Cp-4)

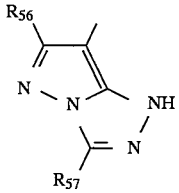
(Cp-5)

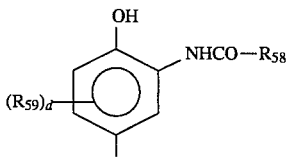
(Cp-6)

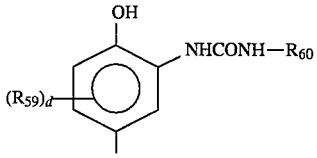
(Cp-7)

-continued (Cp-8)

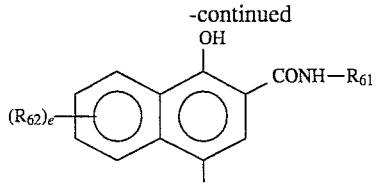

(Cp-9)

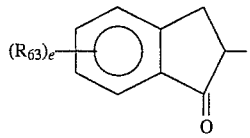

(Cp-10)

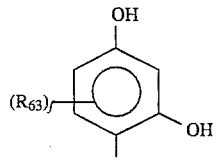

In the above-mentioned formulae, $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ or $R_{63}$ may contain a non-diffusive group which is an organic substituent having a large molecular weight sufficient to immobile in the coupler-containing layer.

Where an R group (which is any one of the groups $R_{51}$ to $R_{63}$) contains a non-diffusive group, the non-diffusive group is selected so that the total number of carbon atoms in the R group is from 8 to 40, preferably from 10 to 30. In all other cases, the total number of carbon atoms in any given R group is preferably 15 or less. In the formulae, the free bond indicates the position at which the group of the formula is bonded to (L)n—$DY_1$ or (L)n—$DY_2$.

$R_{51}$ to $R_{63}$, b, d, e and f are explained in detail hereunder. In the following description, $R_{41}$ represents an alkyl group, an aryl group or a heterocyclic group; $R_{42}$ represents an aryl group or a heterocyclic group; and $R_{43}$, $R_{44}$ and $R_{45}$ each represents a hydrogen atom, an alkyl group, an aryl group or a heterocyclic group. $R_{51}$ has the same meaning as $R_{41}$. $R_{52}$ and $R_{53}$ each have the same meaning as $R_{43}$. b represents 0 or 1. $R_{54}$ has the same meaning as $R_{41}$ or it represents $R_{41}CO(R_{43})N$—, $R_{41}SO_2(R_{43})N$—, $R_{41}(R_{43})N$—, $R_{41}S$—, $R_{43}O$— or $R_{45}(R_{43})NCON(R_{44})$—.

$R_{55}$ has the same meaning as $R_{41}$. $R_{56}$ and $R_{57}$ each have the same meaning as $R_{43}$, or $R_{56}$ and $R_{57}$ each represents $R_{41}S$—, $R_{43}O$—, $R_{41}CO(R_{43})N$— or $R_{41}SO_2(R_{43})N$—. $R_{58}$ has the same meaning as $R_{41}$. $R_{59}$ has the same meaning as $R_{41}$ or it represents $R_{41}CO(R_{43})N$—, $R_{41}OCO(R_{43})N$—, $R_{41}SO_2(R_{43})N$—, $R_{43}(R_{44})NCO(R_{45})N$—, $R_{41}O$—, $R_{41}S$—, a halogen atom, or $R_{41}(R_{43})N$—. d represents an integer from 0 to 3. Where d is a plural number, the plural $R_{59}$'s may be the same or different. $R_{60}$ has the same meaning as $R_{41}$. $R_{61}$ has the same meaning as $R_{41}$. $R_{62}$ has the same meaning as $R_{41}$ or it represents $R_{41}CONH$—, $R_{41}OCONH$—, $R_{41}SO_2NH$—, $R_{43}(R_{44})NCONH$—, $R_{43}(R_{44})NSO_2NH$—, $R_{43}O$—, $R_{41}S$—, a halogen atom or $R_{41}NH$—. $R_{63}$ has the same meaning as $R_{41}$ or it represents $R_{43}CO(R_{44})N$—, $R_{43}(R_{44})NCO$—, $R_{41}SO_2(R_{43})N$—, $R_{41}(R_{43})NSO_2$—, $R_{41}SO_2$—, $R_{43}OCO$—, $R_{43}O$—$SO_2$—, a halogen atom, a nitro group, a cyano group or $R_{43}CO$—. e represents an integer of from 0 to 4. The plural $R_{62}$'s or $R_{63}$'s, if any, may be the same or different. f represents an integer of from 0 to 3.

An alkyl group as referred to herein is a saturated or unsaturated, acyclic or cyclic, linear or branched, substituted or unsubstituted alkyl group having from 1 to 32 carbon atoms, preferably from 1 to 22 carbon atoms. Specific examples of any alkyl group include methyl, cyclopropyl, isopropyl, n-butyl, t-butyl, i-butyl, t-amyl, n-hexyl, cyclohexyl, 2-ethylhexyl, n-octyl, 1,1,3,3-tetramethylbutyi, n-decyl, n-dodecyl, n-hexadecyl and n-octadecyl groups.

An aryl group as referred to herein is a substituted or unsubstituted phenyl or substituted or unsubstituted naphthyl group having from 6 to 20 carbon atoms.

An heterocyclic group as referred to herein is preferably a 3-membered to 8-membered substituted or unsubstituted heterocyclic group having from 1 to 20 carbon atoms, preferably from 1 to 7 carbon atoms and having one or more hetero atoms selected from a nitrogen atom, an oxygen atom and a sulfur atom. Specific examples of a heterocyclic group include 2-pyridyl, 2-benzoxazolyl, 2-imidazolyl, 2-benzimidazolyl, 1-indolyl, 1,3,4-thiadiazol-2-yl, 1,2,4-triazol-2-yl and 1-indolinyl groups.

Where an alkyl, aryl or heterocyclic group as mentioned above has one or more substituents, the substituent(s) may be selected from a halogen atom, $R_{47}O$—, $R_{46}S$—, $R_{47}CO(R_{48})N$—, $R_{47}(R_{48})NCO$—, $R_{46}OCO(R_{47})N$—, $R_{46}SO_2(R_{47})N$—, $R_{47}(R_{48})NSO_2$—, $R_{46}SO_2$—, $R_{47}OCO$—, $R_{47}NCO(R_{48})N$—, $R_{47}CONHSO_2$—, $R_{47}(R_{48})NCONHSO_2$—, $R_{46}$—, $R_{47}(R_{48})$—, $R_{46}COO$—, $R_{47}OSO_2$—, a cyano group and a nitro group. $R_{46}$ represents an alkyl group, an aryl group or a heterocyclic group; $R_{47}$ and $R_{48}$ each represents an alkyl group, an aryl group, a heterocyclic group or a hydrogen atom. The alkyl, aryl and heterocyclic groups have the same meanings as defined hereinabove.

Preferred meanings of $R_{51}$ to $R_{63}$, b, d, e and f are mentioned below.

$R_{51}$ is preferably an alkyl group, an aryl group or a heterocyclic group. $R_{52}$ and $R_{55}$ each are preferably an aryl group. $R_{55}$ is preferably an aryl group when b is 1; and it is preferably a heterocyclic group when b is 0. $R_{54}$ is preferably $R_{41}CONH$— or $R_{41}(R_{43})N$—. $R_{56}$ and $R_{57}$ each are preferably an alkyl group, $R_{41}O$— or $R_{41}S$—.

$R_{58}$ is preferably an alkyl group or an aryl group. In formula (Cp-6), $R_{59}$ is preferably a chlorine atom, an alkyl group or $R_{41}CONH$—. d is preferably 1 or 2. $R_{60}$ is preferably an aryl group. In formula (Cp-7), $R_{59}$ is preferably $R_{41}CONH$—. In formula (Cp-7), d is preferably 1. $R_{51}$ is preferably an alkyl group or an aryl group. In formula (Cp-8), e is preferably 0 or 1. $R_{62}$ is preferably $R_{41}OCONH$—, $R_{41}CONH$— or $R_{41}SO_2NH$; and the position of the group is preferably the 5-position of the naphthol ring shown in the formula. In formula (Cp-9), $R_{63}$ is preferably $R_{41}CONH$—, $R_{41}SO_2NH$—, $R_{41}(R_{43})NSO_2$—, $R_{41}SO_2$—, $R_{41}(R_{43})NCO$—, a nitro group or a cyano group. In formula (Cp-10), $R_{63}$ is preferably $R_{43}NCO$—, $R_{43}OCO$— or $R_{43}CO$—, and f is preferably 0 to 3.

The group represented by L is explained below.

The group represented by L may be any linking group capable of releasing $DY_1$ or $DY_2$ after L has been cleaved from A during development. For instance, L includes a group which utilizes the cleaving reaction of hemiacetals such as the groups described in U.S. Pat. Nos. 4,146,396, 4,652,516 and 4,698,297; a timing group which causes a cleaving reaction by utilizing an intramolecular nucleophilic substitution reaction such as the groups described in U.S. Pat. Nos. 4,248,962, 4,847,185 and 4,857,440; a timing group which causes a cleaving reaction by utilizing an electron transfer reaction such as the groups described in U.S. Pat. Nos. 4,409,323 and 4,421,845; a group which causes a cleaving reaction by utilizing a hydrolyzing reaction of iminoketals such as the groups described in U.S. Pat. No. 4,546,073; and a group which causes a cleaving reaction by utilizing a hydrolyzing reaction of esters such as the groups described in German Patent Laid-Open No. 2,626,317. L bonds to $A_1$, $A_2$ or $A_3$ at a hetero atom in the L group, preferably at an oxygen atom, a sulfur atom or a nitrogen atom in the L group. Preferred examples of L include the L groups represented by the following formulae (L-1), (L-2) and (L-3):

$$*—W—(X{=}Y)_j—C(R_{21})R_{22}—** \quad \text{(L-1)}$$

$$*—W—CO—** \quad \text{(L-2)}$$

$$*—W—LINK—E—** \quad \text{(L-3)}$$

In these formulae, * indicates the position at which the group bonds to $A_1$, $A_2$ or $A_3$ in formula (1), (2) or (3), respectively; ** indicates $DY_1$ or $DY_2$; W represents an oxygen atom, a sulfur atom or >N—$R_{23}$; X and Y each represents a methine group or a nitrogen atom; j represents 0, 1 or 2; and $R_{21}$, $R_{22}$ and $R_{23}$ each represents a hydrogen atom or a substituent. X and Y each independently represents a substituted or unsubstituted methine group. When either X or Y or both X and Y are substituted, the substituents may be or may not be bonded to each other to form a cyclic structure. $R_{21}$, $R_{22}$ and $R_{23}$ may be or may not be bonded to each other to form a cyclic structure (for example, a benzene ring or a pyrazole ring). In formula (L-3), E represents an electrophilic group; and LINK represents a linking group necessary for attaining a steric relationship between W and E such that an intramolecular nucleophilic substitution can take place therebetween.

In formulae (1), (2) and (3), the dye represented by $DY_1$, $DY_2$ or $DY_3$ may be any and every ordinary dye and is preferably such that when it is cleaved from $A_1$, $A_2$, $A_3$ or L during development, the released dye moiety is unstable and is decolored or it is dissolved out from the photographic layer so that substantially no dye is left in the photographic layer. Especially preferred examples of the dye include three types, which are (i) a dye molecule where the dye moiety diffuses as a low molecular form, (ii) a water-soluble dye molecule having a water-soluble group in the dye moiety, which dissolves out in an aqueous medium, and (iii) a dye molecule to be cleaved from $A_1$, $A_2$ or $A_3$ as an azo group, which decomposes to decolot the dye molecule. Suitable water-soluble groups for the dye molecule include a carboxyl group, a sulfo group, a phenolic hydroxyl group, a dissociating imido group and their salts (e.g., metal salts such as sodium salts and potassium salts, and organic salts such as ammonium salts).

Examples of the dye represented by $DY_1$, $DY_2$ and $DY_3$ include azo dyes, azomethine dyes, anthraquinone dyes, indaniline dyes, indigo dyes, oxonole dyes, merocyanine dyes and chelate dyes. Azo dyes, indaniline dyes and azomethine dyes are especially preferred.

$A_1$—(L)n—, $A_2$—(L)n— or $A_3$—(L)n— bonds to the dye at a substituent contained in the dye moiety or at an auxochromic group in the dye. Suitable bonding positions include hetero atoms (e.g., an oxygen atom, a sulfur atom, a nitrogen atom) and conventional coupling split-off groups (split-off groups of 2-equivalent couplers).

Examples of coupling split-off groups, include a nitrogen-containing heterocyclic group which bonds to the coupling position via the nitrogen atom, and also an aryloxy group, an alkoxy group, an arylthio group, a heterocyclic-oxy group, a heterocyclic-thio group, an acyloxy group, a carbamoyloxy group and an alkylthio group.

The couplers of formulae (1), (2) and (3) are preferably non-diffusive couplers, which contain a group capable of making the molecular weight of the molecule sufficiently large since the coupler molecule is to be passivated in the layer to which it has been added. In general, an alkyl group having a total number of carbon atoms of from 8 to 30, preferably from 10 to 20, or an aryl group having a substituent having a total number of carbon atoms of from 4 to 20 is employed as the non-diffusive group. The non-diffusive group may be at any position of the coupler molecule, or two or more of them may be in one coupler molecule.

Specific examples of the couplers of formulae (1), (2) and (3) are given below, which, however, are not limitative.

Examples of couplers of formula (1):

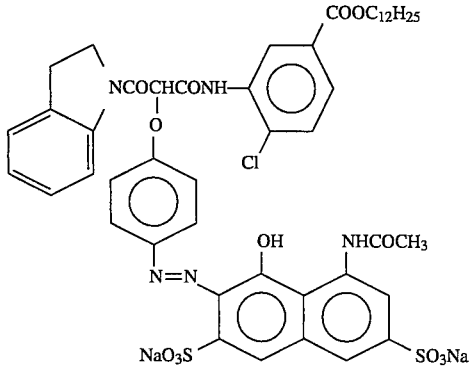

(1)

-continued
(2)
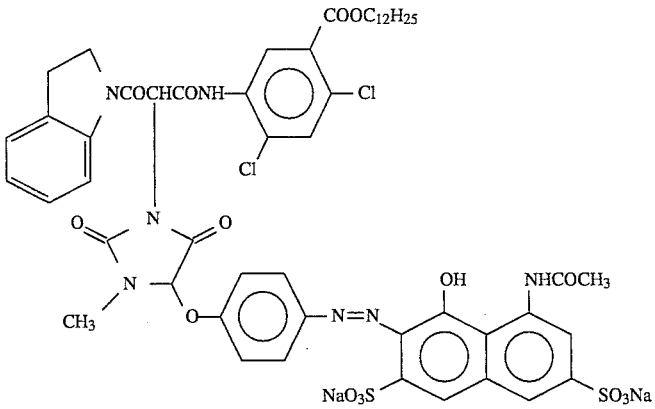
(3)
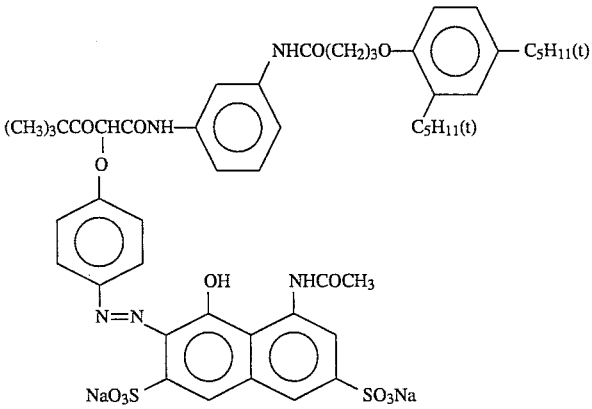
(4)
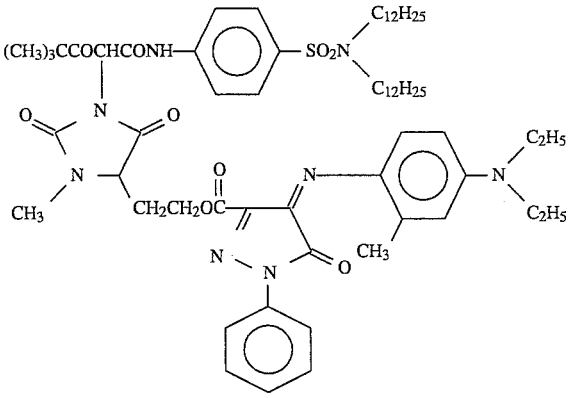
(5)
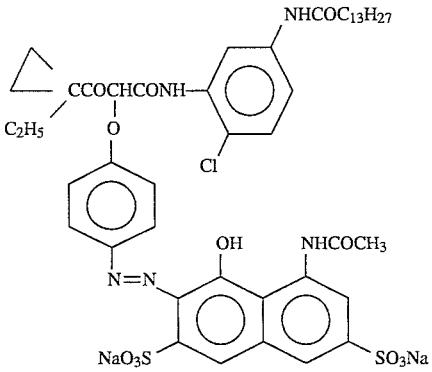

-continued
(6)
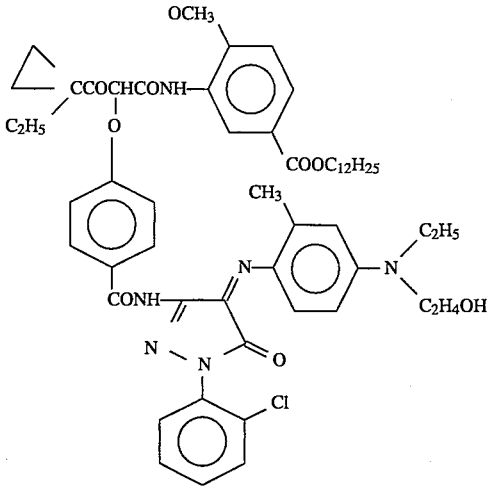
(7)
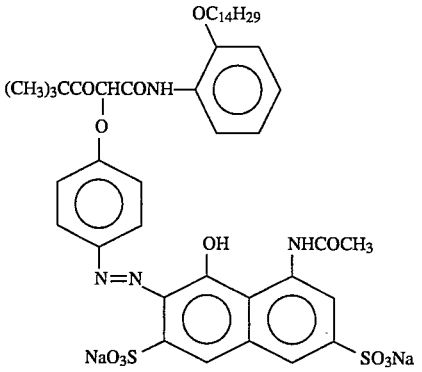
(8)
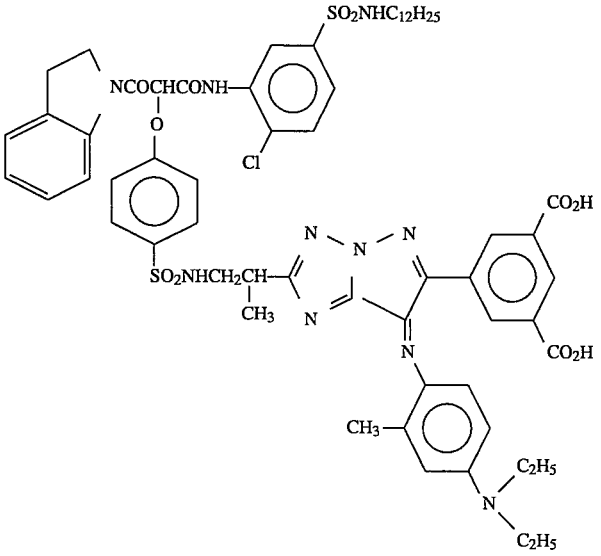

-continued
(9)
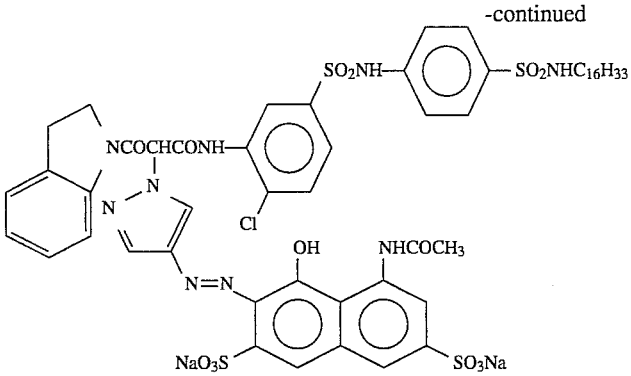
(10)
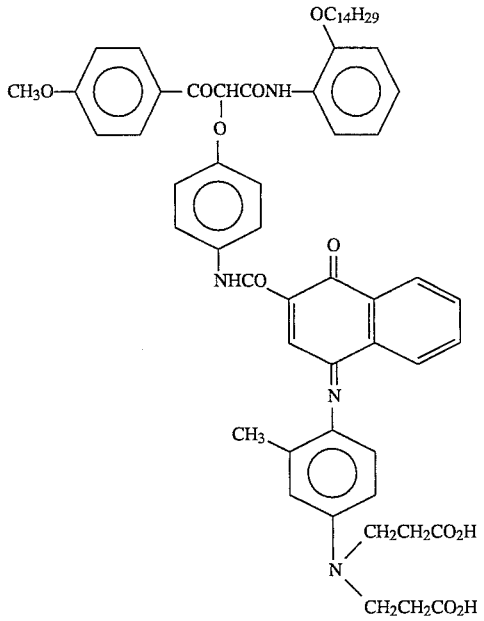
(11)
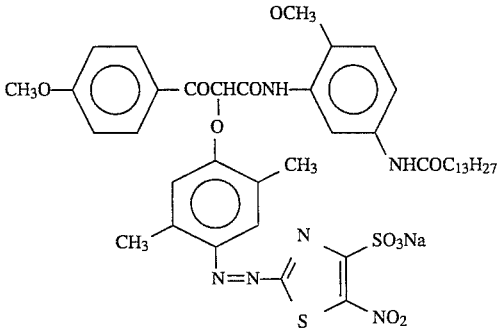
(12)
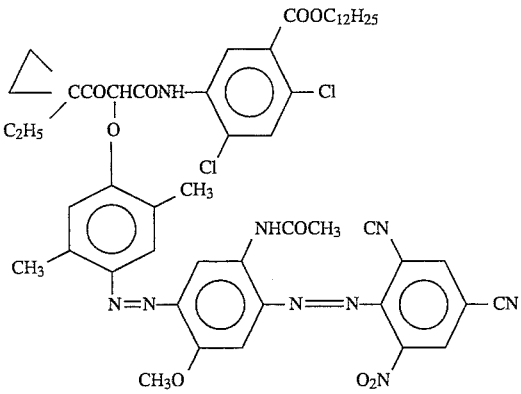

-continued
(13)
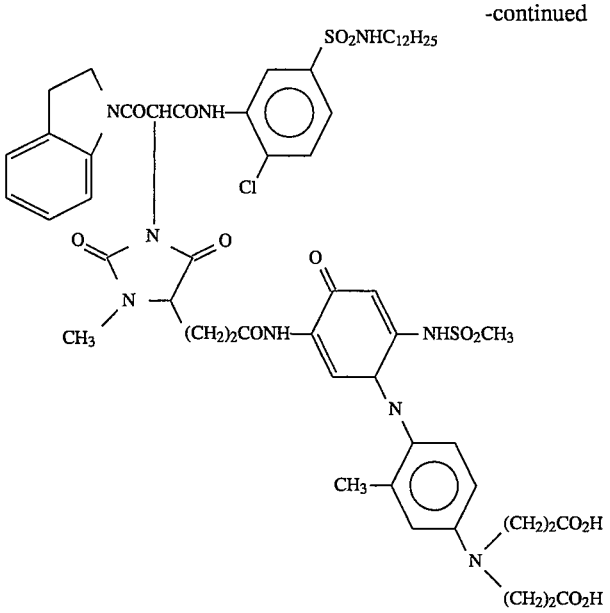
Examples of couplers of formula (2):
(21)
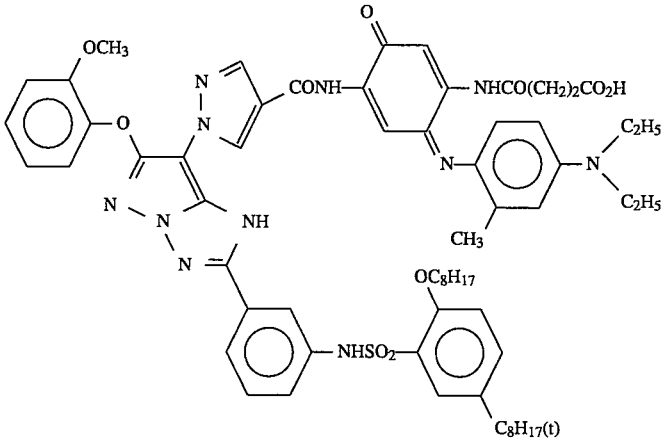
(22)
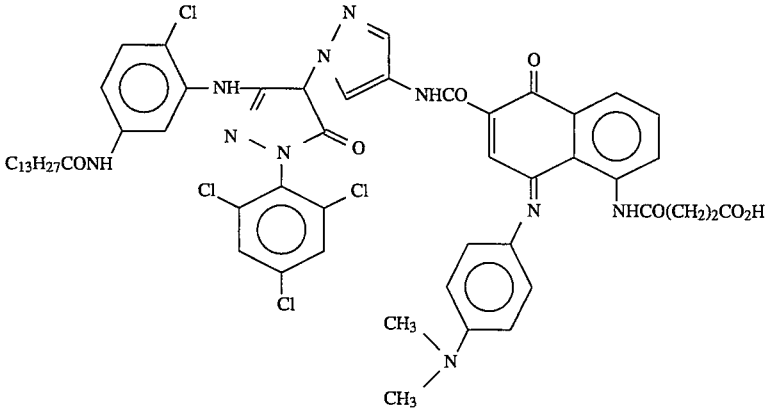

-continued
(23)
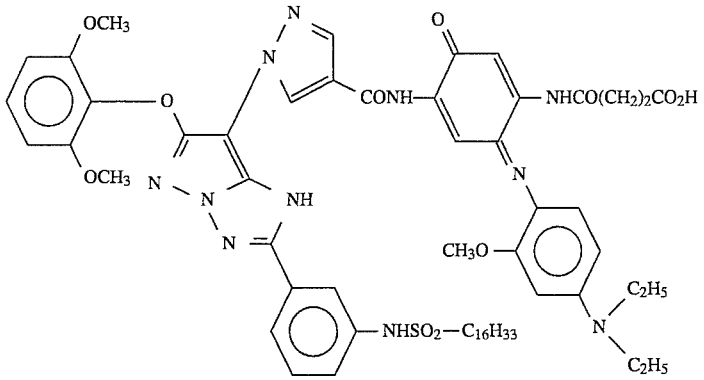
(24)
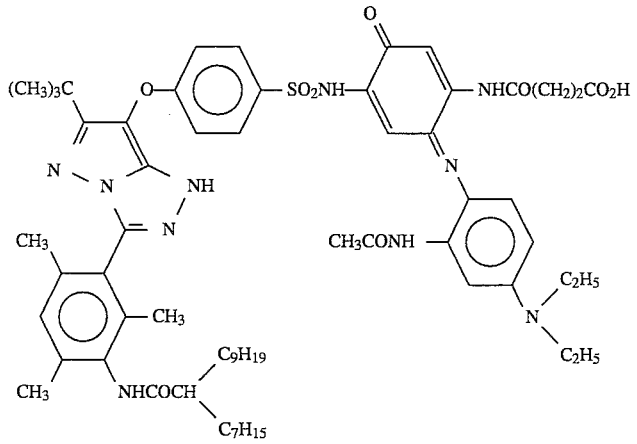
Examples of couplers of formula (3):
(31)
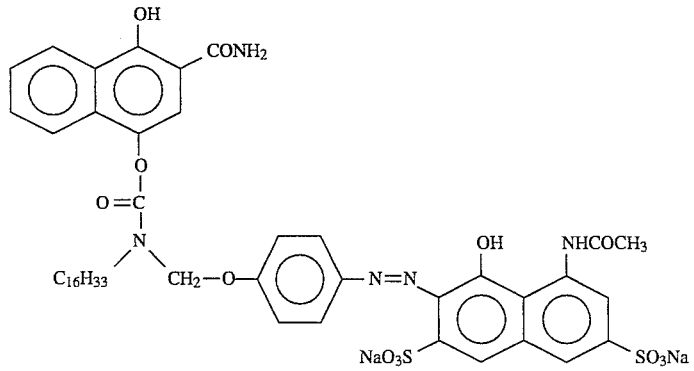
(32)
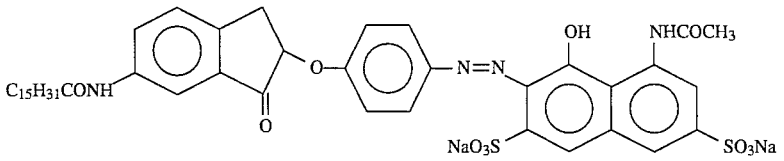

-continued (33)

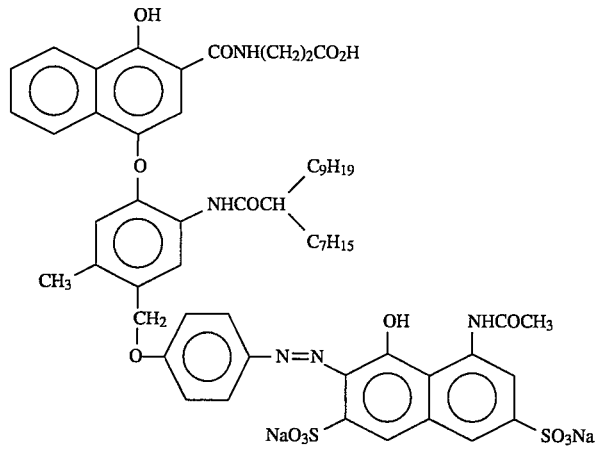

(34)

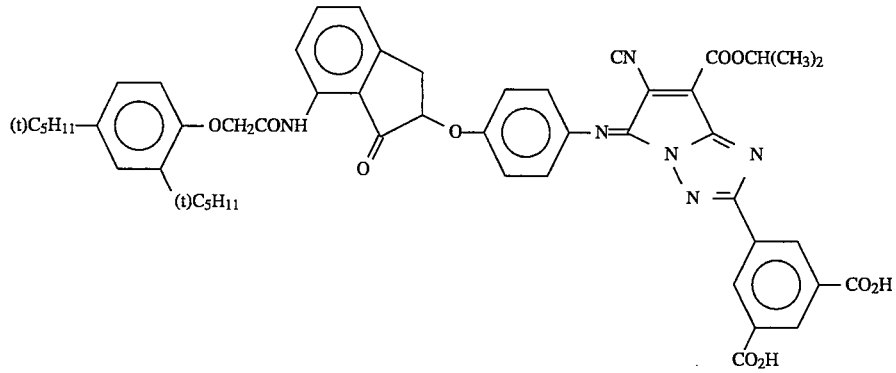

The colored coupler of the present invention may be dissolved under heat in a high boiling point organic solvent and may be emulsified and dispersed in a gelatin solution in the presence of a suitable surfactant, like other oil-soluble couplers. The dispersion may be blended with a silver halide emulsion to easily prepare a coating liquid. In developing the present invention, photographic film samples prepared by coating the coating liquid were subjected to various tests to examine their properties, whereby it was found that the time-dependent stability of the color images as formed by the development processing of samples during storage of the samples for a long period of time was improved.

Colored coupler of the present invention is used preferably in an amount of about $5\times10^{-6}$ to about $5\times10^{-4}$ mol/m$_2$ and more preferably about $1\times10^{-5}$ to about $2\times10^{-4}$ mol/m$^2$.

The silver halide emulsions for use in the present invention are described below.

It is at least necessary that the layer containing an emulsion of tabular silver halide grains of the present invention is one which contains a colored coupler of formula (1), (2) or (3). Addition of an emulsion of tabular silver halide grains to any other layer not containing the colored coupler may optionally be effected with no problem.

The particular emulsion of the present invention contains tabular silver halide grains having an aspect ratio of 3 or more, preferably having a mean aspect ratio of from 3 to less than 8. The term "tabular grain" is a generic name of a grain having one twin plane or two or more parallel twin planes. When the ions of all the lattice points are in a mirror-imagewise relationship in both sides of (111) plane of the grain, the (111) plane is designated as a twin plane. The tabular grain has a triangular, hexangular or roundish circular shape when it is seen from above, and has parallel triangular, hexangular or circular outer surfaces, respectively.

The aspect ratio of the tabular grains of the present invention, which have a grain diameter of 0.1 μm or more, is obtained by dividing the grain diameter by the thickness. Measurement of the thickness of the grains may easily be effected by coating a metal over the grain from the oblique direction along with a latex for reference by vapor deposition, measuring the length of the shadow on an electromicroscopic photograph, and calculating the thickness of the grain with reference to .the length of the shadow of the latex.

The grain diameter of a tabular grain of the present invention is defined as the diameter of a circle having the same area as the projected area of the parallel outer surfaces of the grain.

The projected area of the grain may be obtained by measuring the area on an electromicroscopic photograph followed by compensating for the picture magnification.

The diameter of the tabular grains is preferably from 0.15 to 5 μm. The thickness of the tabular grains is preferably from 0.05 to 1.0 μm.

The mean aspect ratio is obtained as the arithmetical mean value of the aspect ratios of at least 100 individual silver halide grains. It may also be obtained as a ratio of the mean thickness of the grains to the mean diameter of the grains.

The particular emulsion of the present invention contains tabular silver halide grains having an aspect ratio of 3 or more, preferably having a mean aspect ratio of from 3 to less than 8; and the proportion of the tabular silver halide grains in the emulsion is preferably 50% or more based on the entire projected area of all the grains, more preferably 80% or more, based on the entire projected area of all the grains.

The present invention may often attain a more favorable result when it employs monodispersed tabular grains. The structure of monodispersed tabular grains employable in the present invention and the method of producing them may follow, for example, the description of JP-A 63-151618. Briefly referring to the morphology of monodispersed tabular grains usable in the present invention, tabular silver halide grains each having two parallel hexagonal outer surfaces with a ratio of the length of the longest side to the length of the shortest side of 2 or less account for 70% or more of the grains based on the entire projected area of all silver halide grains. The monodispersiveness of the hexagonal tabular silver halide grains is such that the vareation coefficient of the grain size distribution of the grains obtained by dividing the dispersion (standard deviation) of the individual grain size represented by the diameters of the circles having the same areas as the projected areas of the grains by the mean grain size is 20% or less.

The emulsion gains of the present invention may have dislocations.

The dislocations of tabular grains may be observed by a direct method using a transmission electronmicroscope at a low temperature, for example, as described in J. F. Hamilton, *Phot. Sci. Eng.,* 11, 57 (1967) or in T. Shiozawa, *J. Soc. Phot. Sci.,* Japan, 35, 213 (1972). Briefly, in accordance with the direct method, silver halide grains as taken out from an emulsion with special attention paid to not imparting to the grains a pressure causing any additional dislocation of them are put on a mesh for electromicroscopic observation and they are observed by transmission with electron rays under the condition of cooling the sample grains so as to prevent them from being damaged (for example, from being printed out) by the rays. In this case, the larger the thickness of the grains, the smaller the transmission of electron rays as applied thereto. Therefore, use of a high-pressure electronic microscope (for example, at 200 KV or more to a grain having a thickness of 0.25) is recommended for attaining clearer observation. From the photograph of the grain samples as obtained by the method, the positions and the numbers of the dislocations of the individual grains in the vertical direction to the main plane of them may be obtained.

The number of the dislocation lines is one or more, preferably 10 or more, more preferably 20 or more, per grain.

The silver halide in the emulsion for use in the present invention may be any one or more of silver bromide, silver iodobromide, silver iodochlorobromide and silver chlorobromide. Of them, silver iodobromide or silver iodochlorobromide having a silver iodide content of 30 mol % or less are preferred.

The tabular silver halide grains for use in the present invention may easily be prepared by known methods, for example, those described in Cleve, *Photography Theory and Practice* (1930), p. 131; Gutoff, *Photographic Science and Engineering,* Vol. 14, pp. 248–257 (1970); and U.S. Pat. Nos. 4,434,226, 4,414,310, 4,433,048, 4,439,520 and British Patent 2,112,157.

The crystal structure of the individual silver halide grains in the particular silver halide emulsion of the present invention may be uniform, or the grains may have different halogen compositions in the inner part and the outer part. The grains may have a layered structure. Emulsion grains of these kinds are described in, for example, British Patent 1,027,146, U.S. Pat. Nos. 3,505,068 and 4,444,877 and JP-A 60-143331. The grains may be composed of different silver halides joined to each other by epitaxial conjunction. The grains may also contain any compound other than silver halides, such as silver rhodanide or lead oxide, in conjunction with the host silver halide.

The silver halide grains of the particular emulsion of the present invention preferably have a distributed structure with respect to the halogen composition thereof. Typical examples of grains having a distributed structure include core-shell type or two-layered grains having different halogen compositions in the insides (cores) and the surface layers (shells) of the grains. The shapes of the cores of the grains may be or may not be the same as the shape of the shell-covered complete grains. The grains are not limited to be two-layered grains but may also be three-layered or more multi-layered grains, as is disclosed in JP-A-60-222844. If desired, the surfaces of the two-layered core-shell grains may be covered with a thin silver halide layer having a different halogen composition.

In order to vary the structure of the insides of the grains, not only the above-mentioned covered grain having a wrapped structure but also a grain having a so-called conjunction structure may also be prepared. Examples of the latter grains are described in, for example, JP-A 59-133540, 58-108516, EP 199,290A2, JP-B 58-24772 and JP-A 59-16254. The guest crystals to be conjuncted with the host crystals in the grains of these kinds, having a different halogen composition from the host crystals, may be grown on the edges or corners of the host crystals or completely on the whole crystal plane(s) of the host crystals by conjunction. Such conjunction may be applied to either host crystals having a uniform halogen composition or to host crystals not having a uniform halogen composition such as core-shell host crystals.

The conjunction structure is not limited to only a combination of silver halides but may be a combination of silver halides and other silver salt compounds not having a rock salt structure such as silver rhodanide, silver carbonate or the like. In addition, non-silver salt compounds such as PbO or the like may also be employed, if possible, in forming the conjunction structure.

Of the grains having any of the above-mentioned structures, core-shell silver bromoiodide grains may have a higher silver iodide content in the core part and a lower silver iodide content in the shell part, and vice versa. Analogously, silver bromoiodide grains having a conjunction structure may have a higher silver iodide content in the host crystal part and a relatively lower silver iodide content in the conjuncted guest crystal part, and vice versa. The same may apply to the silver chloride content in the grains.

In the grains having any of the above-mentioned structures, the boundary part between the phases each having a different halogen composition may be a definite one or may be an indefinite boundary forming mixed crystals depending upon the difference in the halogen composition therebetween. If desired, the boundary part may have a positive continuous structural variation.

The particular grains of the silver halide emulsion for use in the present invention may be made roundish, for example, in accordance with the methods described in EP-0096727B2- and EP-0064412B1, or the surfaces of them may be modified, for example, in accordance with the methods described in DE-2306447 C2 and JP-A 60-221320.

The silver halide emulsion for use in the present invention is preferably a surface latent image-forming one. If desired, it may also be an internal latent image-forming one, provided that the developer to be used and the conditions for development are suitably selected, for example, in the manner described in JP-A 59-133542. If also desired, a shallow internal latent image-forming emulsion comprising thin shell-covered grains may also be employed in accordance with the objects of the present invention.

In order to promote ripening of the grains of the emulsion, a silver halide solvent is employed. For instance, it is known to incorporate an excessive amount of halide ions into the reactor in which the grains are formed so as to promote ripening of them. Therefore, it is clear that introduction of a halide solution into the reactor, in and of itself, is satisfactory to promote ripening. If desired, any other ripening agent may also be employed for the purpose. The entire necessary amount of the ripening agent, if used, may previously be added to the dispersing medium in the reactor prior to addition of a silver salt and halide(s) thereto. If desired, the ripening agent may be introduced into the reactor along with addition of one or more halides, a silver salt and a peptizer. As another modified embodiment, the ripening agent may be added independently to the reactor during the stage of adding halide(s) and a silver salt thereto.

As ripening agents other than halogen ions, ammonia and amine compounds are also employable. In addition, thiocyanates such as alkali metal thiocyanates, especially potassium or sodium thiocyanate, and also ammonium thiocyanate may also be employed.

The emulsion of the present invention preferably contains silver halide grains having a uniform silver iodide content. The determination as to whether or not the silver iodide content of the silver halide grains constituting the emulsion is uniform may be effected by means of the above-mentioned EPMA (electron-probe micro analyzer) method.

In accordance with the method, a sample of the emulsion which has been well dispersed in order that the emulsion grains are not in contact with each other is prepared and electron beams are irradiated thereto. By X-ray analysis due-to excitation of the electron rays, elementary analysis of the ultra-fine part of the sample is possible. Accordingly, the halogen composition of the individual grains may be determined by obtaining the characteristic X-ray intensity of silver and that of iodine radiated from the individual grains.

When the silver iodide content of the grains constituting the emulsion of the present invention has been determined by the EPMA method, it is preferably 50% or less, more preferably 35% or less, especially preferably 20% or less.

The silver halide emulsion of the present invention is preferably subjected to reduction sensitization during formation of the grains or may be subjected to the reduction sensitization after formation of them but before, during or after chemical sensitization of the grains.

For the reduction sensitization, it is suitable to employ any of a method of adding a reduction sensitizer to the silver halide emulsion, a method of growing or ripening the emulsion grains in a so-called silver ripening atmosphere having a low pAg of from 1 to 7, and a so-called high pH-ripening method of growing or ripening the emulsion grains in a high pH atmosphere having a high pH of from 8 to 11. If desired, two or more of the methods may be employed simultaneously in combinations of them.

The method of adding a reduction sensitizer is preferred, since the level of reduction sensitization of the grains may be accurately adjusted.

Any known reduction sensitizer may be employed for the reduction sensitization of the silver halide emulsion of the present invention, including, for example, stannous salts, ascorbic acid and its derivatives, amines and polyamines, hydrazine derivatives, formamidinesulfinic acid, silane compounds and borane compounds. If desired, two or more of them may be employed in combination. Of these sensitizers, stannous chloride, thiourea dioxide, dimethylaminoborane, and ascorbic acid and its derivatives are especially preferred. The amount of the reduction sensitizer to be used in the method depends upon the conditions of producing the emulsion and therefore it must be selected in accordance with the conditions. Suitably, the amount is from $10^{-7}$ to $10^{-3}$ mol per mol of the silver halide to be sensitized with the reduction sensitizer.

The reduction sensitizer is added to the emulsion during the growth of the emulsion grains, in the form of a solution of the sensitizes dissolved in a solvent such as water, alcohols, glycols, ketones, esters or amides. It may previously be added to the reactor in which the emulsion grains are formed, but it is preferably added thereto at a suitable period during the growth of the grains. If desired, the reduction sensitizer may previously be added to a water-soluble silver salt or to an aqueous solution of water-soluble alkali halide(s), and these aqueous solutions may be used for forming the intended silver halide grains. If also desired, aliquots of a solution of the reduction sensitizer may be added at intervals during the growth of the grains, or alternatively, the solution may continuously be added to the reaction system in which the grains are formed over a long period of time as still another preferred way.

During the step of producing the emulsion of the present invention, an oxidizing agent capable of oxidizing silver is preferably added to the reaction system. The oxidizing agent capable of oxidizing silver is a compound which acts on a metal silver to convert it into a silver ion. As the agent, especially effective is a compound which will convert silver atoms produced during the steps of forming silver halide grains and chemically sensitizing grains, into silver ions. The silver ions to be formed by the oxidation procedure may be formed into sparingly water-soluble silver salts such as silver halides, silver sulfide, silver setenide or the like, or they may be formed into easily water-soluble salts such as silver nitrate or the like. The oxidizing agent capable of oxidizing silver may be either an inorganic substance or an organic substance. Examples of an inorganic oxidizing agent include ozone, hydrogen peroxide and its adducts (e.g., $NaBO_2.H_2O_2.3H_2O$, $2Na_2CO_3.3H_2O_2$, $Na_4P_2O_7.2\ H_2O$, $2Na_2SO_4.H_2O_2.2\ H_2O$); oxyacid salts, such as peroxyacid salts (e.g., $K_2[Ti(O_2)C_2O_4].3H_2O$, $4K_2SO_4.Ti(O_2)OH.SO_4.2H_2O$ (e.g., $K_2S_2O_8$, $K_2C_2O_6$, $K_2P_2O_8$), peroxy complex compounds $Na_3[VO(O_2)(C_2H_4)_2.6H_2O]$), permanganates (e.g., $KMnO_4$) and chromates (e.g., $K_2Cr_2O_7$); halogen elements such as iodine and bromine; perhalogenates (e.g., potassium periodate), salts of metals of higher atomic valencies (e.g., potassium hexacyanoferrate); and thiosulfonates.

Examples of an organic oxidizing agent include quinones such as p-quinone; organic peroxides such as peracetic acid and perbenzoic acid; and compounds capable of releasing an active halogen (e.g., N-bromosuccinimide, chloramine T, chloramine B).

Preferred oxidizing agents for use in the present invention are ozone, hydrogen oxide and its adducts, halogen elements and thiosulfonates as an inorganic oxidizing agent; and quinones and an organic oxidizing agent. Use of combinations of the above-mentioned reduction sensitizer and the oxidizing agent capable of oxidizing silver is a preferred embodiment of carrying out the present invention. In the case of such an embodiment, any of a method of previous addition of an oxidizing agent followed by reduction sensitization and vice versa and a method of using both the two at the same time may be employed suitably. The method may be applied to either of the step of forming the silver halide grains or the step of chemical sensitization of the grains.

The photographic emulsion for use in the present invention may contain various compounds for the purpose of preventing the emulsion from fogging or for the purpose of stabilizing the photographic properties of the emulsion during preparation, storage or processing of the material. Various compounds known as an antifoggant or a stabilizer may be employed for these purposes, including, for example, thiazoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (especially, 1-phenyl-5-mercaptotetrazole); mercaptopyrimidines; mercaptotriazines; thioketo compounds such as oxazolinethione; and azaindenes such as triazaindenes, tetrazaindenes (especially, 4-hydroxy-substituted (1,3,3a,7)tetrazaindenes), and pentazaindenes. For example, the compounds described in U.S. Pat. Nos. 3,954,474, 3,982,947 and JP-B 52-28660 may be employed. As preferred examples, the compounds described in JP-A 62-47225 are mentioned. The antifoggant and stabilizer may be added at any stage before, during or after formation of silver halide grains, during rinsing of them, during dispersion of them after rinsing, before, during or after chemical sensitization of them, and before coating of the emulsion containing them, in accordance with the object. In addition to the essential purpose of expressing the natural anti-fogging and stabilizing effect by adding the antifoggant or stabilizing compounds during preparation of the photographic emulsion, the compounds may also be employed for various other purposes of controlling the crystal habits of the grains, reducing the grain size of the grains, reducing the solubility of the grains, controlling chemical sensitization of the grains and controlling the arrangement of the dyes to be in the photographic material.

The photographic emulsion for use in the present invention is preferably color-sensitized with methine dyes and other dyes in order to effectively attain the effects of the present invention. Usable dyes include cyanine dyes, merocyanine dyes, complex cyanine dyes, complex merocyanine dyes, holopolar cyanine dyes, hemicyanine dyes, styryl dyes and hemioxonole dyes. Of these dyes, cyanine dyes, merocyanine dyes and complex merocyanine dyes are especially useful. The dyes may contain any ordinary basic heterocyclic nuclei which are generally in ordinary cyanine dyes. Suitable nuclei include, for example, pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei; nuclei formed by fusing alicyclic hydrocarbon rings to the nuclei; and nuclei formed by fusing aromatic hydrocarbon rings, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, and quinoline nuclei. The nuclei may be on the carbon atoms of the dyes.

Merocyanine dyes and complex merocyanine dyes may contain, as a nucleus having a ketomethylene structure, 5-membered or 6-membered heterocyclic nuclei such as pyrazolin-5-one nuclei, thiohydantoin nuclei, thioxazoline-2,4-dione nuclei, thiazolidine-2,4-dione nuclei, rhodanine nuclei, and thiobarbituric acid nuclei.

The sensitizing dyes may be employed singly but combinations of them may also be employed. Combinations of sensitizing dyes are often employed especially for the purpose of super color sensitization. Typical examples of suitable combinations are described in U.S. Pat. Nos. 3,617,293, 3,628,964, 3,666,480, 3,672,898, 3,679,428, 3,703,377, 3,769,301, 3,814,609, 3,837,862, and 4,026,707, British Patents 1,344,281, and 1,507,803, JP-B 43-4936, and 53-12375, and JP-A 52-110618, and 52-109925.

Dyes which have no color-sensitizing effect by themselves or substances which do not substantially absorb visible rays but are effective for super-color sensitization may be added to the emulsions along with the sensitizing dyes.

The time of adding the sensitizing dyes to the emulsion may be any stage of the process of preparing the emulsion which has heretofore been known useful. Most generally, the addition is effected after completion of chemical sensitization of the emulsion but before coating of it. However, the dyes may also be added to the emulsion along with addition of a chemical sensitizer thereto for simultaneously effecting both the color sensitization and the chemical sensitization with them, for example, in the manner described in U.S. Pat. Nos. 3,628,969 and 4,225,666; or the addition of the dyes may be effected prior to chemical sensitization of the emulsion, for example, in the manner described in JP-A 58 -113928. If desired, the sensitizing dyes may also be added before completion of the formation of precipitates of silver halide grains so as to initiate color sensitization of the grains being formed. If also desired as is described in U.S. Pat. No. 4,225,666, the compounds to be added may be divided into plural parts in order that a part of them can be added prior to chemical sensitization of the emulsion and the remaining part thereof can be added after chemical sensitization of the emulsion. In addition, the method disclosed in U.S. Pat. No. 4,183,756 may also be employed. In sum, the dyes may be added in any stage of the process of forming silver halide grains of the emulsion.

The amount of the sensitizing dyes to be added may be from about $4\times10^{-6}$ to about $8\times10^{-3}$ mol, per mol of the silver halide to be sensitized therewith. It is more effectively approximately from about $5\times10^{-5}$ to about $2\times 10^{-3}$ mol per mol of silver halide grains having a more preferred grain size of from about 0.2 to about 1.2 μm.

The photographic material of the present invention is not specifically limited, provided that it has at least one blue-sensitive silver halide emulsion layer, at least one green-sensitive silver halide emulsion layer and at least one red-sensitive silver halide emulsion layer on a support. In the material, the number of the silver halide emulsion layers and non-light-sensitive layers as well as the order of the layers on the support is not specifically limited. In a multi-layer silver halide color photographic material, in general, the order of the light-sensitive layer units to be on the support comprises a red-sensitive layer unit, a green-sensitive layer unit and a blue-sensitive layer unit as formed on the support in this order. As the case may be, however, the order may be opposite to the above-mentioned one, in accordance with the objects of the photographic material. As still another embodiment, a different color-sensitive layer may be sandwiched between two other layers of the same color-sensitivity.

Various non-light-sensitive layers such as an interlayer may be provided between the above-mentioned silver halide light-sensitive layers, or on or below the uppermost layer or lowermost layers.

Such an interlayer may contain various couplers and DIR compounds as described in JP-A 61-43748, 59 -113438, 59-113440, 61-20037 and 61-20038, and it may also contain conventional color mixing preventing agents.

As the constitution of the plural silver halide emulsions constituting the respective light-sensitive layer units, preferred is a two-layered constitution composed of a high-sensitivity emulsion layer and a low-sensitivity emulsion layer as described in German Patent 1,121,470 and British Patent 923,045. In general, it is preferred that the plural light-sensitive layers be arranged on the support in such a way that the sensitivity degree of the layer gradually decreases in the direction of the support. In such an embodiment, a non-light-sensitive layer may be provided between the plural silver halide emulsion layers. As another embodiment, a low-sensitivity emulsion layer is formed remote from the support and a high-sensitivity emulsion layer is formed near to the support, as so described in JP-A 57-112751, 62-200350, 62-206541, and 62-206543.

Specific examples of the layer constitution on the support include an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL) from the remotest side from the support; and an order of BH/BL/GL/GH/RH/RL; and an order of BH/BL/GH/GL/RL/RH.

Other examples include an order of blue-sensitive layer/GH/RH/GL/RL from the remotest side from the support, as described in JP-B 55-34932; and an order of blue-sensitive layer/GL/RL/GH/RH from the remotest side from the support, as described in JP-A 56-25738 and 62 -63936.

A further example is a three-layer unit constitution as described in JP-B 49-15495, where the uppermost layer is a highest-sensitivity silver halide emulsion layer, the intermediate layer is a silver halide emulsion layer having a lower sensitivity than the uppermost layer, and the lowermost layer is a silver halide emulsion layer having a further lower sensitivity than the intermediate layer. That is, in the layer constitution of this type, the sensitivity degree of each emulsion layer is gradually lowered in the direction of the support. Even in the three-layer constitution of this type, each of the same color-sensitivity layers may be composed of three layers of middle-sensitivity emulsion layer/high-sensitivity emulsion layer/low-sensitivity emulsion layer as formed in this order from the remotest side from the support, as so described in JP-A 59-202464.

Still other examples of the layer constitution of the photographic material of the present invention include an order of high-sensitivity emulsion layer/ low-sensitivity emulsion layer/middle-sensitivity emulsion layer, and an order of low-sensitivity emulsion layer/middle-sensitivity emulsion layer/high-sensitivity emulsion layer. Where the photographic material of the invention has four or more layers, the layer constitution thereof may be varied in accordance with the manner mentioned above.

In order to improve the color reproducibility, it is desired to provide a doner layer (CL) which has an interlayer effect and which has a different color sensitivity distribution from that of the essential light-sensitive layers of BL, GL and RL, adjacent to or near to the essential light-sensitive layers, in the manner as described in U.S. Pat. Nos. 4,663,271, 4,705,744 and 4,707,436 and JP-A 62-160448 and 63-89850.

As mentioned above, various layer constitutions and arrangements may be selected in accordance with the objects of the photographic material of the invention.

The silver halide photographic emulsions to be used in the present invention may be prepared by various methods, for example, those described in Research Disclosure (RD) No. 17643 (December, 1978), pages 22 to 23 (I. Emulsion Preparation and Types); RD No. 18716 (November, 1979), pages 648; RD No. 307105 (November 1989); P. Glafkides, *Chimie et Physique Photographique* (published by Paul Montel, 1967); G. F. Duffin, *Photographic Emulsion Chemistry* (published by Focal Press, 1966); and V. L. Zelikman et al, Making and Coating Photographic Emulsion (published by Focal Press, 1964).

The photographic material of the present invention preferably contains non-light-sensitive fine silver halide grains. Non-light-sensitive fine silver halide grains are meant to be fine silver halide grains which are not sensitive to the light as imparted to the photographic material for imagewise exposure thereof and are substantially not developed in the step of development of the exposed material. These fine grains are preferably not previously fogged.

The fine silver halide grains have a silver bromide content of from 0 to 100 mol % and, if desired, they may additionally contain silver chloride and/or silver iodide. Preferably, they contain silver iodide in an amount of from 0.5 to 10 mol %.

The fine silver halide grains preferably have a mean grain size of from 0.01 to 0.5 m, more preferably from 0.02 to 0.2/m. The term "mean grain size" means a value obtained by dividing total diameter of each grain by number of grains, in which the diameter is one of circles equivalent to projected area of grains.

The fine silver halide grains may be prepared by the same method as that of preparing ordinary light-sensitive silver halide grains. In such a case, the surfaces of the fine silver halide grains to be prepared do not need to be chemically sensitized and color sensitization of the grains is unnecessary. However, prior to addition of the fine grains to the coating composition, it is desired to previously add a known stabilizer, such as triazole compounds, azaindene compounds, benzothiazolium compounds or, mercapto compound zinc compounds, to the coating composition. The fine silver halide grains-containing layer may preferably contain colloidal silver.

The amount of silver as coated in the photographic material of the present invention is preferably about 6.0 g/m$^2$ or less, most preferably about 4.5 g/m$^2$ or less.

Various known photographic additives which may be used in preparing the photographic materials of the present invention are mentioned in the above-mentioned three Research Disclosures, and the related descriptions therein are shown in the following table.

| Kinds of Additives | RD 17643 | RD 18716 | RD 307105 |
|---|---|---|---|
| 1 Chemical Sensitizer | page 23 | page 648, right column | page 866 |
| 2 Sensitivity Enhancer | | page 648, right column | |
| 3 Color Sensitizing Agent | pages 23 to 24 | page 648, right column, to page 649, right column | pages 866 to 868 |
| Super Color Sensitizing Agent | pages 23 to 24 | page 648, right column, to page 649, right column | pages 866 to 868 |
| 4 Brightening Agent | page 24 | page 647, right column | page 868 |
| 5 Anti-foggant | pages 24 to 25 | page 649, right column | pages 868 to 870 |

-continued

| Kinds of Additives | RD 17643 | RD 18716 | RD 307105 |
|---|---|---|---|
| Stabilizer | pages 24 to 25 | page 649, right column | pages 868 to 870 |
| 6. Light Absorbent | pages 25 to 26 | page 649, right column to page 650, left column | page 873 |
| Filter Dye | pages 25 to 26 | page 649, right column to page 650, left column | page 873 |
| Ultraviolet Absorbent | pages 25 to 26 | page 649, right column to page 650, left column | page 873 |
| 7 Stain Inhibitor | page 25, right column | page 650, left column to right column | page 872 |
| 8 Color Image Stabilizer | page 25 | page 650, left column | page 872 |
| 9 Hardening Agent | page 26 | page 651, left column | pages 874 to 875 |
| 10 Binder | page 26 | page 651, left column | page 873 to 874 |
| 11 Plasticizer, Lubricant | page 27 | page 650, right column | page 876 |
| 12 Coating Aid | pages 26 to 27 | page 650, right column | pages 875 to 876 |
| Surfactant | pages 26 to 27 | page 650, right column | pages 875 to 876 |
| 13 Antistatic Agent | page 27 | page 650, right column | pages 876 to 877 |
| 14 Mat Agent | | | pages 878 to 879 |

In order to prevent deterioration of the photographic properties of the photographic material of the invention by formaldehyde gas which is imparted thereto, compounds capable of reacting with formaldehyde so as to fix it, for example, those described in U.S. Pat. Nos. 4,411,987 and 4,435,503, are preferably incorporated into the material.

It is preferred to incorporate mercapto compounds described in U.S. Pat. Nos. 4,740,454 and 4,788,132 and JP-A 62-18539 and 1-283551 into the photographic materials of the present invention.

It is also preferred to incorporate, into the photographic materials of the present invention, compounds capable of releasing a foggant, a development accelerator, a silver halide solvent or a precursor thereof, irrespective of the amount of the developed silver as formed by development, which are described in JP-A 1 -106052.

It is also preferred to incorporate, into the photographic materials of the present invention, dyes as dispersed by the method described in International Patent Laid-Open No. WO88/04794 and Japanese Patent Kohyo Koho JP-B-1-5029, or dyes as described in European Patent 317,308A, U.S. Pat. No. 4,420,555 and JP-A 1-259358.

Various color couplers can be incorporated into the photographic material of the present invention, and examples of usable color couplers are described in patent publications as referred to in the above-mentioned RD No. 17643, VII-C to G, and RD No. 307105, VII-C to G.

As yellow couplers, for example, those described in U.S. Pat. Nos. 3,933,501, 4,022,620, 4,326,024, 4,401,752, and 4,248,961, JP-B 58-10739, British Patents 1,425,020, and 1,476,760, U.S. Pat. Nos. 3,973,968, 4,314,023, and 4,511,649, and European Patent 249,473A are preferred.

As magenta couplers, 5-pyrazolone compounds and pyrazoloazole compounds are preferred. For instance, those described in U.S. Pat. Nos. 4,310,619, and 4,351,897, European Patent 73,636, U.S. Pat. Nos. 3,061,432, and 3,725,045, RD No. 24220 (June, 1984), JP-A 60-33552, RD No. 24230 (June, 1984), JP-A 60-43659, 61-72238, 60-35730, 55-118034, and 60-185951, U.S. Pat. Nos. 4,500,630, 4,540,654, and 4,556,630, and WO(PCT)88/04795 are preferably used in the present invention.

As cyan couplers, phenol couplers and naphthol couplers are preferred. For instance, those described in U.S. Pat. Nos. 4,052,212, 4,146,396, 4,228,233, 4,296,200, 2,369,929, 2,801,171, 2,771,162, 2,895,826, 3,772,002, 3,758,308, 4,334,011, and 4,327,173, German Patent (OLS) No. 3,329,729, European Patents 121,365A, and 249,453A, U.S. Pat. Nos. 3,446,622, 4,333,999, 4,775,616, 4,451,559, 4,427,767, 4,690,889, 4,254,212, and 4,296,199, and JP-A 61-42658 are preferred. In addition, pyrazoloazole couplers described in JP-A 64-553, 64-554, 64-555 and 64 -556 and imidazole couplers as described in U.S. Pat. No. 4,818,672 are also usable.

Polymerized dye-forming couplers may also be used, and typical examples of such couplers are described in U.S. Pat. Nos. 3,451,820, 4,080,211, 4,367,282, 4,409,320, and 4,576,910, British Patent 2,102,137 and European Patent 341,188A.

Couplers capable of forming a colored dye having a useful diffusibility may also be used, and those described in U.S. Pat. No. 4,366,237, British Patent 2,125,570, European Patent 96,570, and German Patent OLS No. 3,234,533 are preferred.

Additionally, couplers which correct the unnecessary absorption of a colored dyes by the phosphor dye to be released during coupling, as described in U.S. Pat. No. 4,774,181, as well as couplers having a dye precursor group capable of reacting with a developing agent to form a dye, as a split-off group, as described in U.S. Pat. No. 4,777,120, are also preferably used.

Couplers capable of releasing a photographically useful group along with coupling may also be used in the present invention. For instance, as DIR couplers capable of releasing a development inhibitor, those described in the patent publications as referred to in the above-mentioned RD No. 17643, Item VII-F, RD No. 307105, Item VII-F, as well as those described in JP-A 57-151944, 57 -154234, 60-184248, 63-37346 and 63-37350 and U.S. Pat. Nos. 4,248,962 and 4,782,012 are preferred.

Couplers capable of releasing a bleaching accelerator, as described in RD Nos. 11449 and 24241 and JP-A 61-201247, are effective for shortening the time for the processing step with a processing solution having a bleaching capacity, and the effect is especially noticeable when they are added to the photographic material of the present invention containing the above-mentioned tabular silver halide grains.

As couplers capable of imagewise releasing a nucleating agent or development accelerator during development, those described in British Patents 2,097,140 and 2,131,188, and JP-A 59-157638 and 59-170840 are preferred. In addition, compounds capable of releasing a foggant, a development accelerator or a silver halide solvent by redox reaction with an oxidation product of a developing agent, as described in JP-A 60-107029, 60 -252340, 1-44940 and 1-45687, are also preferably used.

Additionally, as examples of compounds which may be incorporated into the photographic materials of the present invention, there are further mentioned competing couplers described in U.S. Pat. No. 4,130,427; poly-valent couplers described in U.S. Pat. Nos. 4,238,472, 4,338,393 and 4,310,618; DIR redox compound-releasing couplers, DIR coupler-releasing couplers, DIR coupler-releasing redox compounds and DIR redox-releasing redox compounds described in JP-A 60-185950 and 62-24252; couplers capable of releasing a dye which recolors after being released from the coupler, as described in European Patents 173,302A and 313,308A; ligand-releasing couplers described in U.S. Pat. No. 4,555,477; leuco dye-releasing couplers described in JP-A 63-75747; and couplers capable of releasing a phosphor dye as described in U.S. Pat. No. 4,774,181.

The above-mentioned couplers can be incorporated into the photographic materials of the present invention by various known dispersion methods.

For instance, an oil-in-water dispersion method may be employed for the purpose. Examples of high boiling point solvents usable in the method are described in U.S. Pat. No. 2,322,027. As examples of high boiling point organic solvents having a boiling point of about 175° C. or higher at normal pressure, which are used in an oil-in-water dispersion, there are mentioned phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl)isophthalate, bis(1,1-diethylpropyl) phthalate, phosphates or phosphonates (e.g., triphenyl phosphate, tricresyl phosphate, 2-ethylhexyl diphenylphosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl-phydroxybenzoate) , amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylates (e.g., bis(2ethylhexyl) sebacate, dioctyl azelate, glycerol tributylate, isostearyl lactate, trioctyl citrate), aniline derivatives (e.g., N,N-dibutyl-2-butoxy-5 -tertoctylaniline), and hydrocarbons (e.g., paraffin, dodecylbenzene, diisopropylnaphthalene) . As an auxiliary solvent, organic solvents having a boiling point of approximately from 30° C. or more, preferably from 50 to 160° C. can be used. As examples of such auxiliary organic solvents, there are mentioned ethyl acetate, butyl acetate, ethyl propionate, methyl ethyl ketone, cyclohexanone, 2-ethoxyethyl acetate and dimethylformamide.

A latex dispersion method may also be employed for incorporating couplers into the photographic material of the present invention. The steps of carrying out the dispersion method, the effect of the method and examples of latexes usable in the method for impregnation are described in U.S. Pat. No. 4,199,363, and German Patent (OLS) Nos. 2,541,274 and 2,541,230.

The color photographic material of the present invention preferably contains an antiseptic or fungicide of various kinds, for example, selected from phenethyl alcohol and those described in JP-A 63-257747, 62-272248 and 1-80941, such as 1,2-benzisothiazolin-3-one, n-butyl p-hydroxybenzoate, phenol, 4-chloro-3,5-dimethylphenol, 2-phenoxyethanol or 2-(4-thiazolyl)benzimidazole.

The present invention may apply to various color photographic materials. For instance, there are mentioned, as typical examples, color negative films for general use or for movie use, color reversal films for slide use or for television use, as well as color papers, color positive films and color reversal papers.

Suitable supports which are usable in the present invention are described in, for example, the above-mentioned RD No. 17643, page 28, RD No. 18716, from page 647, right column to page 648, left column, and RD No. 307105, page 879.

It is desired that the total film thickness of all the hydrophilic colloid layers as provided on the surface of the support having emulsion layers is 28 microns or less, preferably 23 microns or less, more preferably 18 microns or less, especially preferably 16 microns or less, in the photographic material of the present invention. It is also desired that the photographic material of the invention have a film swelling rate (T ½) of 30 seconds or less, preferably 20 seconds or less. The film thickness as referred to herein is one as measured under controlled conditions of a temperature of 25° C. and a relative humidity of 55% (for 2 days); and the film swelling rate as referred to herein may be measured by any means known in this technical field. For instance, it may be measured by the use of a swellometer of the model as described in A. Green et al., *Photographic Science Engineering*, Vol. 19, No. 2, pages 124 to 129. The film swelling rate (T ½) is defined as follows: 90% of the maximum swollen thickness of the photographic material as processed in a color developer under conditions of 30° C. and 3 minutes and 15 seconds is called the saturated swollen thickness. The time necessary for attaining half (½) of the saturated swollen thickness is defined to be the film swelling rate (T ½).

The film swelling rate (T ½) can be adjusted by adding a hardening agent to gelatin of a binder or by varying the conditions of storing the coated photographic material. Additionally, the photographic material of the present invention is desired to have a swelling degree of from 150 to 400%. The swelling degree as referred to herein is calculated from the maximum swollen film thickness as obtained under the above-mentioned condition, on the basis of a formula of:

(maximum swollen film thickness–original film thickness)/(original film thickness).

The photographic material of the present invention may have a hydrophilic colloid layer (this is referred to as a backing layer) having a total dry thickness of from about 2 μm to about 20 μm on the side opposite to the side having the emulsion layers or it may have a layer (this is referred to as a resin backing layer) to be formed by coating a kneaded polymer blend containing a carbon black powder to have an optical transmission density (to a white light) of about 2.0 or less on the side opposite to the side having the emulsion layers. It is preferred that the backing layer contains various additives of the above-mentioned light absorbent, filter dye, ultraviolet absorbent, antistatic agent, hardening agent, binder, plasticizer, swelling agent, coating aid and surfactant. The backing layer preferably has a swelling degree of from 150 to 500%.

The color photographic material of the present invention can be developed by any ordinary method, for example, in accordance with the process described in the above-mentioned RD No. 17643, pages 28 and 29, RD No. 18716, page 651, from left column to right column, and RD No. 307105, pages 880 to 881.

The color developer to be used for development of the photographic material of the present invention is preferably an aqueous alkaline solution consisting essentially of an aromatic primary amine color-developing agent. As the color-developing agent, p-phenylenediamine compounds are preferably used, though aminophenol compounds are also useful. Specific examples of p-phenylenediamine compounds usable as the color-developing agent include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, 4-amino-3-methyl-N-methyl-N-(3-hydroxypropyl)aniline, 4-amino-3-methyl-N-ehtyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-mehtyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-mehtyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, and 4-amino-3-propyl-N-(4-hydroxybutyl)aniline, as well as sulfates, hydrochlorides and p-toluenesulfonates of these compounds. Above all, especially preferred are 3-methyl-4-amino-N-ethyl-N-β-hydroxyethylaniline, 4-amino-3-methyl-N-ethyl-N(3-hydroxypropyl)aniline, 4-amino-3-methyl-N-ethyl-N-(4hydroxybutyl)aniline, and their hydrochlorides, p-toluenesulfonates and sulfates. These compounds can be used in combinations of two or more of them, in accordance with the objects.

The color developer generally contains a pH buffer such as alkali metal carbonates, borates or phosphates, and a development inhibitor or anti-foggant such as chlorides, bromides, iodides, benzimidazoles, benzothiazoles or mercapto compounds. If desired, it may also contain various preservatives such as hydroxylamine, diethylhydroxylamine, sulfites, hydrazines such as N,N-biscarboxymethylhydrazine, phenylsemicarbazides, triethanolamine, catechol-sulfonic acids; an organic solvent such as ethylene glycol or diethylene glycol; a development accelerator such as benzyl alcohol, polyethylene glycol, quaternary ammonium salts, or amines; a dye-forming coupler; a competing coupler; an auxiliary developing agent such as 1-phenyl-3-pyrazolidone; a tackifier; as well as various chelating agents such as aminopolycarboxylic acids, aminopolyphosphonic acids, alkylphosphonic acids, and phosphonocarboxylic acids. As specific examples of chelating agents which may be incorporated into the color developer, there are mentioned ethylenediamine-tetraacetic acid, nitrilo-triacetic acid, diethylenetriamine-pentaacetic acid, cyclohexanediaminetetraacetic acid, hydroxylethylimino-diacetic acid, 1-hydroxyethylidene-1,1-diphosphonic acid, nitrilo-N,N,N-trimethylenephosphonic acid, ethylenediamine-N,N,N,N-tetramethylene-phosphonic acid, ethylenediamine-di(o-hydroxyphenylacetic acid) and their salts.

Where the photographic material is processed for reversal finish, in general, it is first subjected to black-and-white development and then subjected to color development. For the first black-and-white development a black-and-white developer is used, which contains a conventional black-and-white developing agent, for example, dihydroxybenzenes such as hydroquinone, pyraozlidones such as 1-phenyl-3-pyraozlidone, or aminophenols such as N-methyl-p-aminophenol, singly or in combinations of them. The color developer and the black-and-white developer generally have a pH value of from about 9 to about 12. The amount of the replenisher added to the developer is, though depending upon the the color photographic material to be processed, generally about 3 liters or less per $m^2$ of the material to be processed. It may be reduced to about 500 ml or less per $m^2$ of the material to be processed, by lowering the bromide ion concentration in the replenisher. Where the amount of the replenisher is reduced, it is preferred to reduce the contact area of the surface of the processing solution in the processing tank with air so as to prevent vaporization and aerial oxidation of the solution.

The contact surface area of the processing solution with air in the processing tank is represented by the opening ratio which is defined by the following formula:

Opening Ratio=(Contact Surface Area ($cm^2$) of Processing Solution with Air)/(Volume (cm3) of Processing Tank)

The above-mentioned opening ratio is preferably 0.1 or less, more preferably from 0.001 to 0.05. Various means can be employed for the purpose of reducing the opening ratio, which include, for example, provision of a masking substance such as a floating lid on the surface of the processing solution in the processing tank, employment of the mobile lid described in JP-A 1-82033 and employment of the slit-developing method described in JP-A 63-216050. Reduction of the opening ratio is preferably applied to not only both the steps of color development and black-and-white development but also to all the subsequent steps such as bleaching, bleach-fixation, fixation, rinsing and stabilization. In addition, the amount of the replenisher to be added may also be reduced by means of suppressing accumulation of bromide ions in the developer.

The time for color development is generally within the range of from about 2 minutes to about 5 minutes, but the processing time may be shortened by elevating the processing temperature, elevating the pH value of the processing solution and elevating the concentration of the processing solution.

After being color developed, the photographic emulsion layer is generally desilvered by bleaching and fixing. Bleaching may be effected simultaneously with fixation (bleach-fixation) or separately therefrom. In order to accelerate the processing speed, a system of bleaching followed by bleach-fixation may also be employed. If desired, a system using a bleach-fixing bath of two continuous tanks, a system of fixation followed by bleach-fixation, or a system of bleach-fixation followed by bleaching may also be employed, in accordance with the object. As the bleaching agent can be used, for example, compounds of polyvalent metals such as iron(III), as well as peracids, quinones and nitro compounds. Specific examples of the bleaching agent usable in the present invention include organic complexes of iron(III), such as complexes thereof with amino-polycarboxylic acids such as ethylenediaminetetraacetic acid, diethylenetriaminepentaacetic acid, cyclohexanediamine-tetraacetic acid, methyliminodiacetic acid, 1,3-diaminopropane-tetraacetic acid or glycol ether-diamine-tetraacetic acid or with organic acids such as citric acid, tartaric acid or malic acid. Among them, aminopolycarboxylato/iron(III) complexes such as ethylenediaminetetraacetato/iron(III) complex and 1,3-diaminopropane-tetraacetato/iron(III) complex are preferred in view of the rapid processability thereof and of prevention of environmental pollution. The aminopolycarboxylato/iron(III) complexes are especially useful both in a bleaching solution and in a bleach-fixing solution. The bleaching solution or bleach-fixing solution containing such aminopolycarboxylato/iron(III) complexes generally has a pH value of from about 4.0 to about 8.0, but the solution may have a lower pH value for rapid processing.

The bleaching solution, the bleach-fixing solution and the previous bath may contain a bleaching accelerating agent, if desired. Various bleaching accelerating agents are known, and examples of the are agents which advantageously used in the present invention include mercapto group- or disulfide group-containing compounds described in U.S. Pat. No. 3,893,858, German Patents 1,290,812 and 2,059,988, JP-A 53-32736, 53-57831, 53 -37418, 53-72623, 53-95630, 53-95631, 53-104232, 53-124424, 53-141623 and 53-28426, RD No. 17129 (July, 1978); thiazolidine derivatives as described in JP-A 50-140129; thiourea derivatives as described in JP-B 45-8506, JP-A 52-20832 and 53-32735 and U.S. Pat. No. 3,706,561; iodide salts as described in German Patent 1,127,715 and JP-A 58 -16235; polyoxyethylene compounds as described in German Patents 966,410 and 2,748,430; polyamine compounds as described in JP-B 45-8836; other compounds as described in JP-A 49-40943, 49-59644, 53-94927, 54-35727, 55-26506 and 58-163940; and bromide ions. Above all, mercapto group or disulfide group-containing compounds, in particular, those as described in U.S. Pat. No. 3,893,858, German Patent 1,290,812 and JP-A 53-95630 are preferred, as having a large accelerating effect. In addition, compounds described in U.S. Pat. No. 4,552,834 are also preferred. These bleaching accelerators may be incorporated into the photographic material of the invention. Where the material of the invention is a picture-taking color photographic material and it is bleach-fixed, these bleaching accelerators are especially effective.

The bleaching solution and bleach-fixing solution may further contain, in addition to the above-mentioned components, various organic acids for the purpose of preventing bleaching stains. Especially preferred organic acids for the purpose are those having an acid dissociating constant (pKa) of from about 2 to about 5. For instance, acetic acid, propionic acid and hydroxyacetic acid are preferably used.

As the fixing agent in the fixing solution or bleach-fixing solution to be applied to the photographic material of the invention, usable are thiosulfates, thiocyanates, thioether compounds, thioureas, and a large amount of iodide salts. Use of thiosulfates is conventional for this purpose. Above all, ammonium thiosulfate is most widely used. Additionally, combinations of thiosulfates and thiocyanates, thioether compounds or thioureas are also preferred. As the preservative to be used in the fixing solution or bleach-fixing solution, preferred are sulfites, bisulfites and carbonyl-bisulfite adducts, as well as sulfinic acid compounds as described in European Patent 294769A. Further, the fixing solution or bleach-fixing solution may preferably contain various aminopolycarboxylic acids or organic phosphonic acids for the purpose of stabilizing the solution.

It is preferred that the fixing solution or bleach-fixing solution to be used for processing the photographic material of the present invention contain compounds having a pKa value of from about 6.0 to about 9.0, for the purpose of adjusting the pH value of the solution. As such compounds, preferably added are imidazoles such as imidazole, 1-methylimidazole, 1-ethylimidaozle or 2-mehtylimidazole, in an amount of from 0.1 to 10 mol/liter.

The total time for the desilvering process is preferably shorter so long as it does not cause desilvering insufficiency. For instance, the time is preferably from about 1 minute to about 3 minutes, more preferably from 1 minute to 2 minutes. The processing temperature may be from about 25° C. to about 50° C., preferably from about 35° C. to about 45° C. In such a preferred temperature range, the desilvering speed is accelerated and generation of stains in the processed material may effectively be prevented.

In the desilvering process, it is desired that stirring of the processing solution during the process be promoted as much as possible. As examples of reinforced stirring means for forcedly stirring the photographic material during the desilvering step, there are mentioned a method of running a jet stream of the processing solution to the emulsion-coated surface of the material, as described in JP-A 62-183460; a method of promoting the stirring effect by the use of a rotating means, as described in JP-A 62-183461; a method of moving the photographic material being processed in the processing bath while the emulsion-coated surface of the material is brought into contact with a wiper blade provided in the processing bath, whereby the processing solution applied to the emulsion-coated surface of the material is made turbulent and the stirring effect is promoted; and a method of increasing the total circulating amount of the processing solution. Such reinforced stirring means are effective for any of the bleaching solution, bleach-fixing solution and fixing solution. It is considered that reinforcement of stirring of the processing solution promotes penetration of the bleaching agent and fixing agent into the emulsion layer of the photographic material being processed and, as a result, the desilvering rate in processing the material is elevated. The above-mentioned reinforced stirring means is more effective, when a bleaching accelerator is incorporated into the processing solution. Because of these means, therefore, the bleaching accelerating effect can be remarkably augmented, and the fixation preventing effect by the bleaching accelerator can be avoided.

The photographic material of the present invention can be processed with an automatic developing machine. It is desired that the automatic developing machine to be used for processing the material of the present invention be equipped with a photographic material-conveying means as described in JP-A 60-191257, 60-191258 and 60-191259. As is noted from the relevant disclosure of JP-A 60 -191257, the conveying means may noticeably reduce the carry-over amount from the previous bath to the subsequent bath and therefore it is extremely effective for preventing deterioration of the processing solution being used. Because of these reasons, the conveying means is especially effective for shortening the processing time in each processing step and for reducing the amount of the replenisher to each processing bath.

The silver halide color photographic material of the present invention is generally rinsed in water and/or stabilized, after being desilvered. The amount of water to be used in the rinsing step can be set in a broad range, in accordance with the characteristics of the photographic material being processed (for example, depending upon the raw material components, such as the coupler and so on) or the use of the material, as well as the temperature of the rinsing water, the number of the rinsing tanks (the number of the rinsing stages), the replenishment system of normal current or countercurrent flow and various other conditions. Among these conditions, the relation between the number of the rinsing tanks and the amount of the rinsing water in a multi-stage countercurrent rinsing system can be obtained by the method described in *Journal of the Society of Motion Picture and Television Engineers,* Vol. 64, pages 248 to 253 (May, 1955).

According to the multi-stage countercurrent system described in the above-mentioned reference, the amount of the rinsing water to be used can be reduced noticeably, but because of the prolongation of the residence time of the water in the rinsing tank, bacteria may propagate in the tank so that the floating substances generated by the propagation of bacteria would adhere to the surface of the material as it is being processed. Accordingly, the above system would often have a problem. In the practice of processing the photographic material of the present invention, the method of reducing calcium and magnesium ions, which is described in JP-A 62-288838, can extremely effectively be used for overcoming this problem. In addition, isothiazolone compounds and thiabendazoles described in JP-A 57-8542; chlorine-containing bactericides such as chlorinated sodium isocyanurates; and benzotriazoles and other bactericides described in H. Horiguchi, *Chemistry of Bactericidal and Fungicidal Agents* (1986, by Sankyo Publishing Co., Japan), Bactericidal and Fungicidal Techniques to Microorganisms, edited by Association of Sanitary Technique, Japan (1982, by Kogyo Gijutsu-kai, Japan), and *Encyclopeadia of Bactericidal and Fungicidal Agents,* edited by Nippon Bactericide and Fungicide Association, Japan (1986), can also be used.

The pH value of the rinsing water to be used for processing the photographic material of the present invention is from about 4 to about 9, preferably from about 5 to about 8. The temperature of the rinsing water and the rinsing time can also be set variously in accordance with the characteristics of the photographic material being processed as well as the use thereof, and in general, the temperature is from about 15 to about 45° C. and the time is from about 20 seconds to about 10 minutes, and preferably the temperature is from about 25 to about 40° C. and the time is from about 30 seconds to about 5 minutes. Alternatively, the photographic material of the present invention may also be processed directly with a stabilizing solution in place of being rinsed with water. For the stabilization, any known methods, for example, as described in JP-A 57-8543, 58-14834 and 60-220345, can be employed.

In addition, the material can also be stabilized, following the rinsing step. As one example of such a case, there may be mentioned a stabilizing bath containing a dye stabilizer and a surfactant, which is used as a final bath for picture-taking color photographic materials. As examples of dye stabilizers usable for the purpose, there are mentioned aldehydes such as formalin and glutaraldehyde, N-methyiol compounds, hexamethylenetetramine and aldehyde-sulfite adducts. The stabilizing bath may also contain various chelating agents and fungicides.

The overflow from the rinsing and/or stabilizing solutions because of addition of replenishers thereto may be re-used in the other steps such as the previous desilvering step.

Where the photographic material of the present invention is processed with an automatic developing machine system and the processing solutions being used in the step are evaporated and thickened, it is desired to add water to the solutions so as to correct the concentration of the solutions.

The silver halide color photographic material of the present invention can contain a color developing agent for the purpose of simplifying and accelerating the processing of the material. For incorporation of a color developing agent into the photographic material, various precursors of the agent are preferably used. For example, there are mentioned indoaniline compounds described in U.S. Pat. No. 3,342,597, Schiff base compounds described in U.S. Pat. No. 3,342,599 and RD Nos. 14850 and 15159, aldole compounds described in RD No. 13924, metal complexes described in U.S. Pat. No. 3,719,492 and urethane compounds described in JP-A 53-135628, as the precursors.

The silver halide color photographic material of the present invention can contain various kinds of 1-phenyl-3-pyrazolidones, if desired, for the purpose of accelerating the color developability thereof. Specific examples of these compounds are described in JP-A 56 -64339, 57-144547 and 58-115438.

The processing solutions for the photographic material of the invention are used at about 10° C. to about 50° C. In general, a processing temperature of from about 33° C. to about 38° C. is standard, but the temperature may be made higher so as to accelerate the processing or to shorten the processing time, or on the contrary, the temperature may be made lower so as to improve the quality of images formed and to improve the stability of the processing solution used.

The silver halide color photographic material of the present invention is especially effectively applied to lens-combined film units such as those described in JP-B 2-32615 and Examined Japanese Utility Model Publication No. 3-39784, as easily expressing the effect.

Next, the present invention will be explained in more detail by way of the following examples, which, however, are not intended to restrict the scope of the present invention.

EXAMPLE 1

Tabular Silver Halide Emulsion (A) As Used In This Example Was Prepared In The Manner Mentioned Below An aqueous solution prepared by dissolving 13 g of inactive gelatin having a low molecular weight of 50,000 (mean molecular weight) and 2.5 g of potassium bromide in one liter of distilled water was stirred at 30° C., to which were added an aqueous 1M-solution of silver nitrate and an aqueous 1M-solution of potassium bromide and potassium iodide (97/3, by mol) each at a flow rate of 50 cc/min for 24 seconds. Then, the pAg value of the reaction system was increased to 10 and 20 g of inactive gelatin was added thereto. With heating up to 63° C., this was ripened for 30 minutes to form tabular nuclei.

Next, 100 cc of an aqueous 1M silver nitrate solution and an aqueous 1M-solution of potassium bromide and potassium iodide (97/3, by mol) were added to the above each at the same molar addition rate near to the critical growth rate, whereby the tabular nuclei were grown to a tabular silver bromide emulsion. The growth required 0.28 mol of silver nitrate in all. The adjustment of the aspect ratio of the tabular grains to be formed was effected by suitably controlling the pAg value during the second stage addition. The aspect ratio of the finally grown grains was 5.0.

Other tabular silver halide emulsions (B), (C), (D) and (E) mentioned in the following Table 1 were prepared in the same manner as emulsion (A) except that the grain size of the respective emulsions was controlled to give the respective grain sizes and aspect ratios shown in Table 1.

TABLE 1

| Emulsion | Grain Size (*1) | Aspect Ratio | Silver Iodide Content |
|---|---|---|---|
| A | 0.31 | 5.0 | 3 mol % |
| B | 0.25 | 4.4 | 3 mol % |
| C | 0.19 | 3.3 | 3 mol % |
| D | 0.23 | 4.6 | 3 mol % |

TABLE 1-continued

| Emulsion | Grain Size (*1) | Aspect Ratio | Silver Iodide Content |
|---|---|---|---|
| E | 0.17 | 3.1 | 3 mol % |

(*1) This is the diameter of a sphere having the same volume as the grain.

Using the emulsions prepared above, photographic material samples were prepared in the manner mentioned below.

Coating of Backing Layer

A backing layer having the composition mentioned below was coated on the non-light-sensitive surface a support. The amount of the backing layer coated was controlled so that the density thereof to a white light was 1,0. A cellulose triacetate film was used as the support.

| | |
|---|---|
| Composition of Coating Liquid of Backing Layer: | |
| Methyl Methacrylate-Methacrylic Acid Copolymer (copolymerization ratio of 1/1 by mol) | 1.5 parts |
| Cellulose Acetate Hexahydrophthalate (hydroxypropyl group 4%; methyl group 15%; acetyl group 8%; phthalyl group 36%) | 1.5 parts |
| Acetone | 50 parts |
| Methanol | 25 parts |
| Methyl Cellosolve | 25 parts |
| Colloidal Carbon | 1.2 parts |

Plural layers each having the composition mentioned below were coated on the backing layer-coated support to prepare a multi-layer color photographic material Sample No. 101.

| | |
|---|---|
| First Layer: Anti-halation Layer | |
| Gelatin layer containing black colloidal silver | 0.30 g/m$^2$ |
| Second Layer: interlayer | |
| Compound (H-1) | 0.18 g/m$^2$ |
| Ultraviolet Absorbent (C-1) | 0.08 g/m$^2$ |
| Ultraviolet Absorbent (C-2) | 0.11 g/m$^2$ |
| Third Layer: First Red-sensitive Emulsion Layer Gelatin layer containing: | |
| Silver Iodobromide Emulsion (silver iodide 4 mol %; cubic grains with mean grain size of 0.14 μm) | 0.38 g/m$^2$ as Ag |
| Sensitizing Dye (I) | 7.0 × 10$^{31\ 5}$ mol per mol of Ag |
| Sensitizing Dye (II) | 2.0 × 10$^{-5}$ mol per mol of Ag |
| Sensitizing Dye (III) | 2.8 × 10$^{-4}$ mol per mol of Ag |
| Sensitizing Dye (IV) | 2.0 × 10$^{-5}$ mol per mol of Ag |
| Coupler (C-3) | 0.40 g/m$^2$ |
| Coupler (C-4) | 0.02 g/m$^2$ |
| Coupler (C-5) | 0.02 g/m$^2$ |
| High Boiling Point Solvent (Solv-1) | 0.11 g/m$^2$ |
| High Boiling Point Solvent (Solv-2) | 0.11 g/m$^2$ |
| Fourth Layer: Second Red-sensitive Emulsion Layer Gelatin layer containing: | |
| Silver Iodobromide Emulsion (silver iodide 4 mol %, cubic grains with mean grain size of 0.18 μm) | 0.13 g/m$^2$ as Ag |
| Sensitizing Dye (I) | 5.2 × 10$^{-5}$ mol per mol of Ag |
| Sensitizing Dye (II) | 1.5 × 10$^{-5}$ mol per mol of Ag |
| Sensitizing Dye (III) | 2.1 × 10$^{-4}$ mol per mol of Ag |
| Sensitizing Dye (IV) | 1.5 × 10$^{-5}$ mol per mol of Ag |
| Coupler (C-3) | 0.20 g/m$^2$ |
| Coupler (C-4) | 0.01 g/m$^2$ |
| Coupler (C-5) | 0.01 g/m$^2$ |
| High Boiling Point Solvent (Solv-1) | 0.06 g/m$^2$ |
| High Boiling Point Solvent (Solv-2) | 0.05 g/m$^2$ |
| Fifth Layer: Third Red-sensitive Emulsion Layer Gelatin layer containing: | |
| Silver Iodobromide Emulsion (silver iodide 4 mol %; cubic grains with mean grain size of 0.25 μm) | 0.18 g/m$^2$ as Ag |
| Sensitizing Dye (I) | 5.5 × 10$^{-5}$ mol per mol of Ag |
| Sensitizing Dye (II) | 1.6 × 10$^{-5}$ mol per mol of Ag |
| Sensitizing Dye (III) | 2.2 × 10$^{-5}$ mol per mol of Ag |
| Sensitizing Dye (IV) | 1.6 × 10$^{-5}$ mol per mol of Ag |
| Coupler (C-3) | 0.10 g/m$^2$ |
| High Boiling Point Solvent (Solv-1) | 0.02 g/m$^2$ |
| High Boiling Point Solvent (Solv-2) | 0.03 g/m$^2$ |
| Sixth Layer: Interlayer Gelatin layer containing: | |
| Compound (H-1) | 0.02 g/m$^2$ |
| Seventh Layer: First Green-sensitive Emulsion Layer | |
| Silver Iodobromide Emulsion (silver iodide 4 mol %; cubic grains with mean grain size of 0.14 μm) | 0.35 g/m$^2$ as Ag |
| Sensitizing Dye (V) | 4.0 × 10$^{-4}$ mol per mol of Ag |
| Sensitizing Dye (VI) | 4.0 × 10$^{-5}$ mol per mol of Ag |
| Coupler (C-6) | 0.20 g/m$^2$ |
| Coupler (C-7) | 0.04 g/m$^2$ |
| Coupler (C-8) | 0.04 g/m$^2$ |
| Coupler (C-9) | 0.01 g/m$^2$ |
| High Boiling Point Solvent (Solv-1) | 0.15 g/m$^2$ |
| High Boiling Point Solvent (Solv-2) | 0.15 g/m$^2$ |
| Eighth Layer: Second Green-sensitive Emulsion Layer Gelatin layer containing: | |
| Silver Iodobromide Emulsion (silver iodide 4 mol %; cubic grains with mean grain size of 0.19 μm) | 0.20 g/m$^2$ as Ag |
| Sensitizing Dye (V) | 3.5 × 10$^{-4}$ mol per mol of Ag |
| Sensitizing Dye (VI) | 3.5 × 10$^{-5}$ mol per mol of Ag |
| Coupler (C-9) | 0.10 g/m$^2$ |
| Coupler (C-7) | 0.001 g/m$^2$ |
| Coupler (C-8) | 0.001 g/m$^2$ |
| High Boiling Point Solvent (Solv-1) | 0.10 g/m$^2$ |
| Ninth Layer: Third Green-sensitive Emulsion Layer Gelatin layer containing: | |
| Silver Iodobromide Emulsion (silver iodide 4 mol %; cubic grains with mean grain size of 0.25 μm) | 0.14 g/m$^2$ as Ag |
| Sensitizing Dye (V) | 3.0 × 10$^{-4}$ mol per mol of Ag |
| Sensitizing Dye (VI) | 3.0 × 10$^{-5}$ mol per mol of Ag |
| Coupler (C-9) | 0.03 g/m$^2$ |
| Coupler (C-8) | 0.001 g/m$^2$ |
| High Boiling Point Solvent (Solv-1) | 0.03 g/m$^2$ |
| Tenth Layer: Yellow Filter Layer Gelatin layer containing: | |
| Yellow Colloidal Silver | 0.16 g/m$^2$ |
| Compound (H-1) | 0.20 g/m$^2$ |

-continued

| | |
|---|---|
| Eleventh Layer: First Blue-sensitive Emulsion Layer Gelatin layer containing: | |
| Silver Iodobromide Emulsion (silver iodide 1 mol %; cubic grains with mean grain size of 0.19 μm) | 0.25 g/m$^2$ as Ag |
| Coupler (C-10) | 0.68 g/m$^2$ |
| High Boiling Point Solvent (Solv-1) | 0.24 g/m$^2$ |
| Twelfth Layer: Second Blue-sensitive Emulsion Layer Gelatin layer containing: | |
| Silver Iodobromide Emulsion (silver iodide 1 mol %; cubic grains with mean grain size of 0.24 μm) | 0.25 g/m$^2$ as Ag |
| Coupler (C-10) | 0.16 g/m$^2$ |
| High Boiling Point Solvent (Solv-1) | 0.06 g/m$^2$ |
| Thirteenth Layer: Third Blue-sensitive Emulsion Layer Gelatin layer containing: | |
| Silver Iodobromide Emulsion (silver iodide 1 mol %; cubic grains with mean grain size of 0.30 μm) | 0.40 g/m$^2$ as Ag |
| Coupler (C-10) | 0.14 g/m$^2$ |
| High Boiling Point Solvent (Solv-1) | 0.05 g/m$^2$ |
| Fourteenth Layer: First Protective Layer Gelatin layer containing: | |
| Ultraviolet Absorbent (C-1) | 0.20 g/m$^2$ |
| Ultraviolet Absorbent (C-2) | 0.10 g/m$^2$ |
| High Boiling Point Solvent (Solv-1) | 0.16 g/m$^2$ |
| Fifteenth Layer: Second Protective Layer Gelatin layer containing | |
| MMA/MAA = 90/10 (by mol) | 7 mg/m$^2$ |
| Lubricant (B-1) | 0.10 g/m$^2$ |

In addition to the above-mentioned components, the layers optionally contained gelatin hardening agent (C-11), surfactants (W-1) to (W-4), antifoggants (F-1) and (F-2) and viscosity increasing agent (B-2).

Formation of Photographic Material Sample No. 102

Sample No. 102 was prepared in the same manner as in preparation of Sample No. 101, except that the cubic silver halide emulsions of the eleventh layer to the thirteenth layer were replaced by tabular silver halide emulsions (A), (B) and (C), respectively. The aspect ratios, the grain sizes and the halogen compositions of the tabular silver halide emulsions (A), (B) and (C) have been described in Table 1 above.

Formation of Photographic Material Sample No. 103

Sample No. 103 was prepared in the same manner as in preparation of Sample No. 101, except that an emulsified dispersion of the above-mentioned Compound (2) of the present invention was added to the eleventh layer to the thirteenth layer. The amount of the compound added was 20 mg/m$^2$ to the eleventh layer, 15 mg/m$^2$ to the twelfth layer and 10 mg/m$^2$ to the thirteenth layer; and the amount of gelatin in these layers was well controlled so that the thickness of the individual coated layers was not different from that in sample No. 101.

Formation of Photographic Material Sample No. 104

Sample No. 104 was prepared in the same manner as in preparation of Sample No. 103, except that the cubic silver halide emulsions of the eleventh layer to the thirteenth layer were replaced by tabular silver halide emulsions (A), (B) and (C), respectively.

Formation of Photographic Material Sample Nos. 105 to 109

Sample Nos. 105 to 109 were prepared in the same manner as in preparation of Sample No. 102 having tabular grains in the eleventh layer to the thirteenth layer, except that a colored coupler of the above-mentioned Compound (3) of the present invention was added to the layer(s) as indicated in Table 2 below, the amount of the compound (3) as added to the layer(s) also being indicated in Table 2. In sample No. 105, the amount of the compound (3) was 18 mg/m$^2$ in the eleventh layer, 13 mg/m$^2$ in the twelfth layer and 9 mg/m$^2$ in the thirteenth layer; and in sample No. 109, it was 17 mg/m$^2$ in the eleventh layer, 13 mg/m$^2$ in the twelfth layer and 8 mg/m$^2$ in the thirteenth layer.

Formation of Photographic Material Sample Nos. 110 and 111

Sample No. 110 was prepared in the same manner as in preparation of Sample No. 103, except that the colored coupler added was changed to the above-mentioned Compound (10) of the present invention. Sample No. 111 was prepared in the same manner as in preparation of Sample No. 110, except that the cubic silver halide emulsions in the eleventh layer to the thirteenth layer were replaced by tabular silver halide emulsions (A), (B) and (C), respectively. The ratio of the tabular silver halide emulsions in the three layers of Sample No. 111 was same as that in the three layers of Sample No. 103.

Formation of Photographic Material Sample Nos. 112 and 113

Sample Nos. 112 and 113 were prepared in the same manner as in preparation of Sample Nos. 110 and 111, respectively, except that the colored coupler was replaced by Compound (11) of the invention. The ratio of Compound (11) in the three layers in Sample Nos. 112 and 113 was same as that in Sample No. 103.

Formation of Photographic Material Sample Nos. 114 and 115

Sample No. 114 was prepared in the same manner as in Sample No. 101, except that the cubic silver halide emulsions in the green-sensitive seventh to ninth layers were replaced by silver halide emulsion (D) in the seventh layer, silver halide emulsion (C) in the eighth layer and silver halide emulsion (E) in the ninth layer. Sample No. 115 was prepared in the same manner as in preparation of Sample No. 101, except that Compound (21) of the invention in the amount indicated in Table 2 was added to the seventh layer to the ninth layer. The ratio of Compound (21) in the seventh layer to the ninth layer in Sample No. 115 was 44% in the seventh layer, 33% in the eighth layer and 23% in the ninth layer.

Formation of Photographic Material Sample Nos. 116 to 120

Sample Nos. 116 to 120 were prepared in the same manner as Sample No. 115, except that the colored coupler as indicated in Table 2 and the silver halide grains also as indicated in Table 2 were employed. The ratio of Compound (22) as added to Sample No. 117 in the individual layers in Sample No. 117 was same as that in Sample No. 115.

Formation of Sample No. 121

Sample No. 121 was prepared in the same manner as in preparation of Sample No. 101, except that tabular silver halide emulsions (A) to (C) were used in the eleventh layer to the thirteenth layer, respectively, along with a colored coupler of Compound (2) of the invention in them and that tabular silver halide emulsions (D), (C) and (E) were used in the seventh layer to the ninth layer, respectively, along with a colored coupler of Compound (21) of the invention.

The chemical formulae of the compounds used in the present example are shown below.

C-1

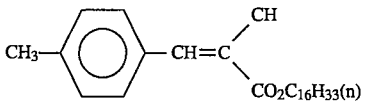

C-2

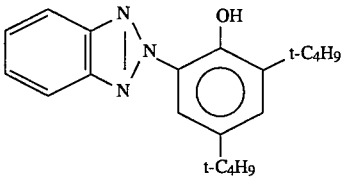

C-3

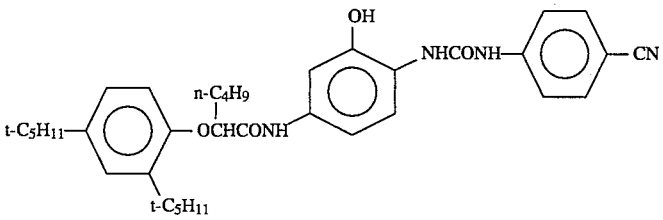

C-4

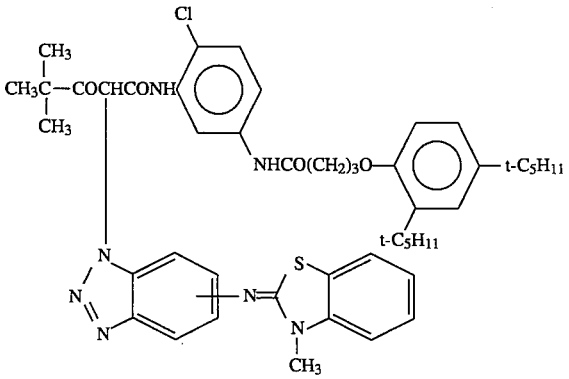

C-5

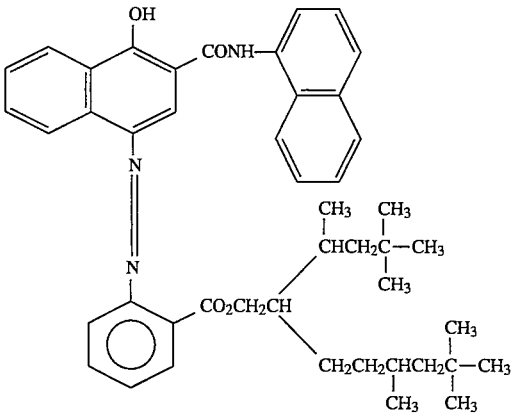

-continued
C-6
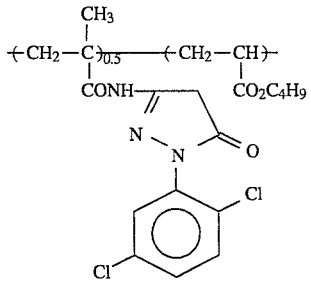
C-7
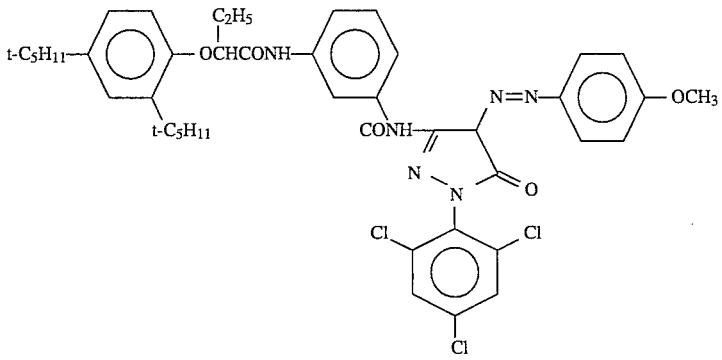
C-8
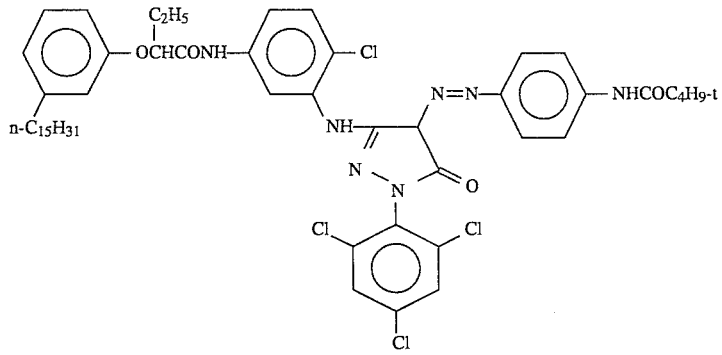
C-9
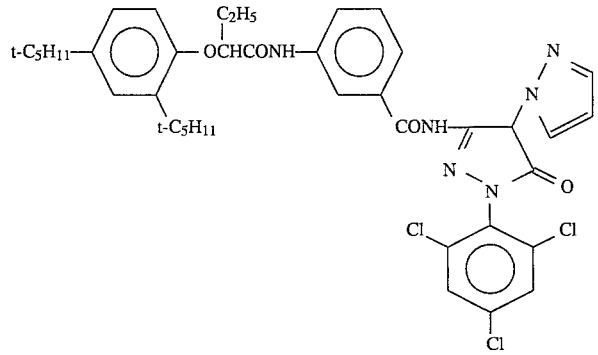

-continued
C-10
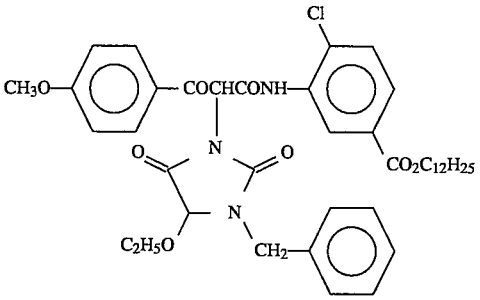
C-11
$(CH_2{=}CHSO_2CH_2CONHCH_2)_2$
H-1
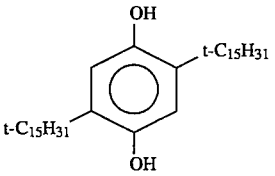
Sensitizing Dye I:
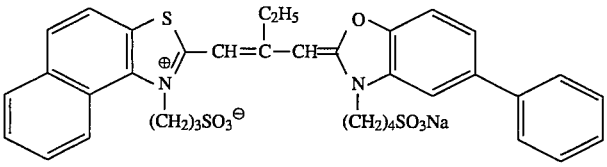
Sensitizing Dye II:
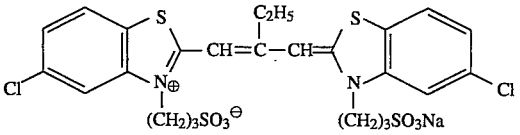
Sensitizing Dye III:
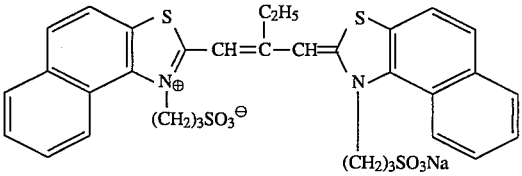
Sensitizing Dye IV:
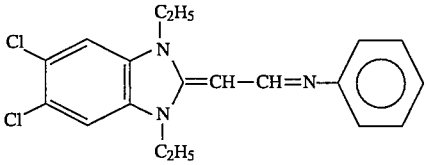
Sensitizing Dye V:
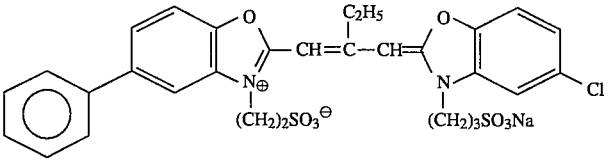

-continued
Sensitizing Dye VI:
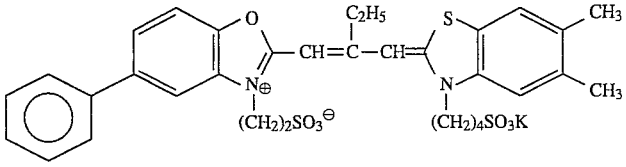
B-1
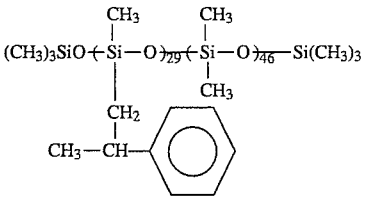
B-2
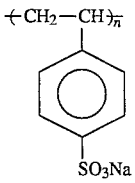
Solv-1
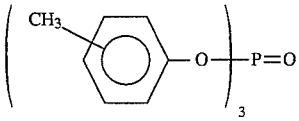
Solv-2
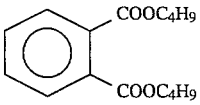
W-1
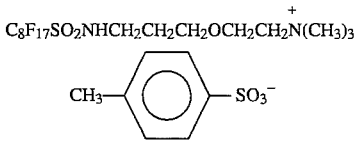
W-2
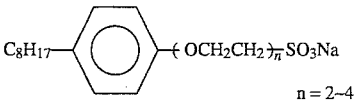
n = 2~4
W-3
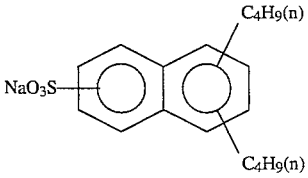
W-4
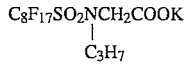

-continued

F-1

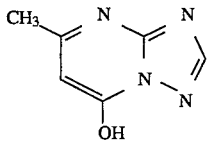

F-2

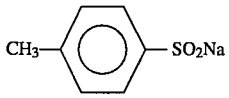

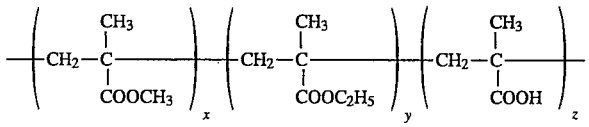

x:y:z = 20:20:60
(by weight)

Sample Nos. 101 to 108, 110 and 111 as formed in the manners mentioned above were subjected to uniform green exposure and then to blue-imagewise exposure. The exposed samples were subjected to color development in the manner described below. The degree of color turbidity of each of the thus processed samples is shown in Table 2 below, which was obtained by subtracting the magenta density in the yellow-fogged density area from the magenta density in the point of the non-exposed area having the yellow density plus 0.5, 1.0, or 2.0.

Sample Nos. 101, 102, 109, 112 and 113 were subjected to uniform red exposure and then to blue-imagewise exposure. The exposed samples were subjected to color development in the manner mentioned below. The degree of color turbidity of each of the thus processed samples is shown in Table 2 below, which was obtained by subtracting the cyan density in the yellow-fogged density area from the cyan density in the point of the non-exposed area having the yellow density plus 0.5, 1.0, or 2.0.

Sample Nos. 101 and 114 to 120 were subjected to uniform red exposure and then to green-imagewise exposure. The exposed samples were subjected to color development in the manner mentioned below. The degree of color turbidity of each of the thus processed samples is shown in Table 2 below, which was obtained by subtracting the magenta-fogged density from the cyan density in the point of the non-exposed area having the magenta density plus 0.5, 1.0, or 2.0.

In order to examine the sharpness of these samples, all the samples were subjected to pattern-wise white exposure for determination of the MTF values. The exposed samples were then subjected to color development, and the MTF values of the individual colors (R, G, B) were obtained.

All the samples, Nos. 101 to 120, were subjected to imagewise white exposure and then subjected to color development in the manner mentioned below. By measurement of the densities of the individual colors (R, G, B), the sensitometry curves were obtained. The strips used for sensitometry were stored in an atmosphere having a temperature of 55° C. and a relative humidity of 65% for 6 weeks and then again subjected to sensitometrical determination to obtain the individual sensitometry curves. From them, the variation or difference in the density between the fogged area and the area having the fog density plus 1.0 was obtained. The difference indicates the color image stability of each sample, which is shown in Table 3 below.

The exposed Samples Nos. 101 to 121 were processed in accordance with the process mentioned below.

| Step | Temperature (°C.) | Time |
|---|---|---|
| (1) Pre-bath | 27 +/− 1 | 10 sec |
| (2) Removal of Packing and Spray-Washing | 27 to 38 | 5 sec |
| (3) Color Development | 41.1 +/− 0.1 | 3 min |
| (4) Stopping | 27 to 38 | 30 sec |
| (5) Bleaching Acceleration | 27 +/− 1 | 30 sec |
| (6) Bleaching | 38 +/− 1 | 3 min |
| (7) Rinsing | 27 to 38 | 1 min |
| (8) Fixation | 38 +/− 1 | 2 min |
| (9) Rinsing | 27 to 38 | 2 min |
| (10) Stabilization | 27 to 38 | 10 sec |
| (11) Drying | 32 to 43 | 6 min |

Compositions of the processing solutions used in the processing steps are described below.

| | |
|---|---|
| (1) Pre-bath: | |
| Water of 27 to 38° C. | 800 ml |
| Borax (10-hydrate) | 20.0 g |
| Sodium Sulfate (anhydride) | 100 g |
| Sodium Hydroxide | 1.0 g |
| Water to make | 1.00 liter |
| pH (27° C.) | 9.25 |
| (3) Color Developer: | |
| Water of 21 to 38° C. | 850 ml |
| Kodak Anti-calcium No. 4 | 2.0 ml |
| Sodium Sulfite (anhydride) | 2.0 g |
| Eastman Anti-fog No. 9 | 0.22 g |
| Sodium Bromide (anhydride) | 1.20 g |

-continued

| | |
|---|---|
| Sodium Carbonate (anhydride) | 25.6 g |
| Sodium Bicarbonate | 2.7 g |
| Color Developing Agent, 4-(N-ethyl-N-(β-methanesulfonamidoethyl)-m-toluidine | 4.0 g |
| Water to make | 1.00 liter |
| pH (27° C.) | 10.20 |
| (4) Stopping Bath: | |
| Water of 21 to 38° C. | 900 ml |
| 7.0 N Sulfuric Acid | 50 ml |
| Water to make | 1.00 liter |
| pH (27° C.) | 0.9 |
| (5) Bleaching Accelerator | |
| Water | 900 ml |
| Sodium Metabisulfite (anhydride) | 10.0 g |
| Glacial Acetic Acid | 25.0 ml |
| Sodium Acetate | 10.0 g |
| EDTA-4Na | 0.7 g |
| PBA (2-dimethylaminoehtylisothiourea 2-hydrochloride) | 5.5 g |
| Water to make | 1.0 liter |
| pH (27° C.) | 3.8 +/− 0.2 |

-continued

| | |
|---|---|
| (6) Bleaching Solution: | |
| Water of 24 to 38° C. | 800 ml |
| Gelatin | 0.5 g |
| Sodium Persulfate | 33.0 g |
| Sodium Chloride | 15.0 g |
| Sodium Primary Phosphate (anhydride) | 9.0 g |
| Phosphoric Acid (85%) | 2.5 ml |
| Water to make | 1.0 liter |
| pH (27° C.) | 2.3 +/− 0.2 |
| (8) Fixing Solution: | |
| Water of 20 to 38° C. | 700 ml |
| Kodak Anti-calcium No. 4 | 2.0 ml |
| 58% Ammonium Thiosulfate Solution | 185 ml |
| Sodium Sulfite (anhydride) | 10.0 g |
| Sodium Bisulfite (anhydride) | 8.4 g |
| Water to make | 1.0 liter |
| pH (27° C.) | 6.5 |
| (10) Stabilizer: | |
| Water of 21 to 27° C. | 1.00 liter |
| Kodak Stabilizer Additive | 0.14 ml |
| Formalin (37.5% solution) | 1.50 ml |

TABLE 2

| | Colored Coupler | | | | Color Turbidity | | |
|---|---|---|---|---|---|---|---|
| Sample | Compound | Layer(s) | Amount (mg/m$^2$) | Silver Halide Emulsion | 0.5 | 1.0 | 2.0 |
| 101 (comparative sample) | — | — | — | All layers contained cubic emulsions. | (*1)0.04 | 0.08 | 0.12 |
| | | | | | (*2)0.03 | 0.06 | 0.11 |
| | | | | | (*3)0.02 | 0.03 | 0.07 |
| 102 (comparative sample) | — | — | — | 11th to 13th layers contained emulsions A, B, C. | 0.04 | 0.08 | 0.13 |
| 103 (comparative sample) | (2) | 11 to 13 | total 45 | All layers contained cubic emulsions. | 0.00 | −0.01 | 0.03 |
| 104 (sample of the invention) | (2) | 11 to 13 | total 45 | 11th to 13th layers contained emulsions A, B, C. | 0.00 | −0.01 | 0.02 |
| 105 (sample of the invention) | (3) | 11 to 13 | total 40 | 11th to 13th layers contained emulsions A, B, C. | 0.00 | 0.00 | 0.02 |
| 106 (sample of the invention) | (3) | 13 | 20 | 11th to 13th layers contained emulsions A, B, C. | −0.01 | 0.02 | 0.05 |
| 107 (sample of the invention) | (3) | 12 | 20 | 11th to 13th layers contained emulsions A, B, C. | 0.01 | −0.01 | 0.04 |
| 108 (sample of the invention) | (3) | 11 | 20 | 11th to 13th layers contained emulsions A, B, C. | 0.02 | 0.03 | 0.04 |
| 109 (sample of the invention) | (31) | 11 to 13 | total 38 | 11th to 13th layers contained emulsions A, B, C. | 0.00 | 0.01 | 0.02 |
| 110 (comparative sample) | (10) | 11 to 13 | total 40 | All layers contained cubic emulsions. | 0.01 | 0.02 | 0.04 |
| 111 | (10) | 11 to 13 | total 40 | 11th to 13th layers contained | 0.01 | 0.01 | 0.04 |

TABLE 2-continued

| Sample | Colored Coupler Compound | Colored Coupler Layer(s) | Colored Coupler Amount ($mg/m^2$) | Silver Halide Emulsion | Color Turbidity 0.5 | Color Turbidity 1.0 | Color Turbidity 2.0 |
|---|---|---|---|---|---|---|---|
| (sample of the invention) | | | | emulsions A, B, C. | | | |
| 112 (comparative sample) | (11) | 11 to 13 | 37 | All layers contained cubic emulsions. | 0.00 | 0.01 | 0.03 |
| 113 (sample of the invention) | (11) | 11 to 13 | 37 | 11th to 13th layers contained emulsions A, B, C. | 0.00 | 0.01 | 0.03 |
| 114 (comparative sample) | — | — | — | 7th to 9th layers contained emulsions D, C, E. | 0.02 | 0.04 | 0.07 |
| 115 (comparative sample) | (21) | 7 to 9 | total 42 | All layers contained cubic emulsions. | −0.01 | −0.01 | 0.02 |
| 116 (sample of the invention) | (21) | 7 to 9 | total 42 | 7th to 9th layers contained emulsions D, C, E. | 0.00 | 0.00 | 0.02 |
| 117 (sample of the invention) | (22) | 7 to 9 | total 39 | 7th to 9th layers contained emulsions D, C, E. | −0.01 | 0.00 | 0.02 |
| 118 (sample of the invention) | (22) | 9 | 20 | 7th to 9th layer contained emulsions D, C, E. | −0.01 | 0.02 | 0.05 |
| 119 (sample of the invention) | (22) | 8 | 20 | 7th to 9th layers contained emulsions D, C, E. | 0.01 | 0.00 | 0.04 |
| 120 (sample of the invention) | (22) | 7 | 20 | 7th to 9th layers contained emulsions D, C, E. | 0.02 | 0.02 | 0.04 |
| 121 (sample of the invention) | (2) | 11 to 13 | 45 | 11th to 13th layers contained emulsions A, B, C. | 0.00 | 0.00 | 0.02 |
| | (21) | 7 to 9 | 42 | 7th to 9th layer contained emulsions D, C, E. | −0.01 | 0.00 | 0.03 |

(*1) Color turbidity after uniform green exposure followed by blue-imagewise exposure.
(*2) Color turbidity after uniform red exposure followed by blue-imagewise exposure.
(*3) Color turbidity after uniform red exposure followed by green-imagewise exposure.

TABLE 3

| | MTF Value (20 cycles/mm) | | | Color Image Storage Stability | | |
|---|---|---|---|---|---|---|
| Sample | Yellow | Magenta | Cyan | Yellow | Magenta | Cyan |
| 101 | 0.86 | 0.79 | 0.71 | +0.05/−0.06 | +0.11/+0.13 | ±0/−0.02 |
| 102 | 0.85 | 0.81 | 0.73 | +0.05/−0.05 | +0.11/+0.12 | ±0/−0.02 |
| 103 | 0.86 | 0.81 | 0.71 | +0.04/−0.04 | 0.07/+0.07 | ±0/−0.02 |
| 104 | 0.86 | 0.84 | 0.74 | +0.04/−0.03 | +0.06/+0.06 | ±0/−0.01 |
| 105 | 0.86 | 0.84 | 0.73 | +0.03/−0.04 | +0.06/+0.07 | ±0/−0.01 |
| 106 | 0.86 | 0.82 | 0.73 | +0.04/−0.05 | +0.09/+0.12 | ±0/−0.01 |
| 107 | 0.86 | 0.82 | 0.74 | +0.04/−0.05 | +0.09/+0.11 | ±0/−0.01 |
| 108 | 0.86 | 0.83 | 0.73 | +0.04/−0.04 | +0.09/+0.10 | ±0/−0.01 |
| 109 | 0.86 | 0.84 | 0.73 | +0.03/−0.04 | +0.07/+0.07 | ±0/−0.02 |
| 110 | 0.86 | 0.81 | 0.73 | +0.04/−0.04 | +0.08/+0.07 | ±0/−0.01 |
| 111 | 0.86 | 0.84 | 0.75 | +0.04/−0.04 | +0.07/+0.07 | ±0/−0.01 |
| 112 | 0.86 | 0.80 | 0.73 | +0.04/−0.04 | +0.07/+0.07 | ±0/−0.01 |
| 113 | 0.86 | 0.84 | 0.76 | +0.04/−0.04 | +0.07/+0.07 | ±0/±0 |
| 114 | 0.85 | 0.80 | 0.73 | +0.05/−0.06 | +0.11/+0.13 | ±0/−0.02 |
| 115 | 0.86 | 0.80 | 0.73 | +0.05/−0.05 | +0.08/+0.08 | ±0/±0 |
| 116 | 0.86 | 0.82 | 0.77 | +0.05/−0.05 | +0.08/+0.08 | ±0/−0.01 |
| 117 | 0.86 | 0.82 | 0.78 | +0.04/−0.05 | +0.08/+0.08 | ±0/±0 |
| 118 | 0.86 | 0.82 | 0.75 | +0.04/−0.05 | +0.08/+0.09 | ±0/−0.01 |
| 119 | 0.86 | 0.82 | 0.75 | +0.04/−0.05 | +0.08/+0.09 | ±0/−0.01 |
| 120 | 0.86 | 0.81 | 0.75 | +0.04/−0.05 | +0.08/+0.09 | ±0/−0.01 |
| 121 | 0.86 | 0.85 | 0.77 | +0.04/−0.04 | +0.06/+0.05 | ±0/−0.01 |

From the results shown in Tables 2 and 3 above, it is understood that Sample Nos. 104, 109, 111, 113, 116, 117 and 121 of the present invention, containing a colored coupler of the present invention in combination with tabular silver halide emulsions of the present invention are much superior to the comparative Sample Nos. 101 to 103 with respect to the color turbidity values and the MTF values. In addition, the color image storage stability of the samples of the present invention was much more improved than that of the comparative samples, unexpectedly. It is also understood that when the combination of a colored coupler and a tabular silver halide emulsion of the present invention is limited to only the first emulsion layer, the content of the colored coupler to be in the layer is limitative in order to attain the intended object. Therefore, it is noted from this fact that the colored coupler and the tabular silver halide emulsion are preferably in plural emulsion layers so as to more effectively attain the objects of the present invention.

EXAMPLE 2

Preparation Of Tabular Silver Halide Emulsions To Be Used In The Present Example Is Mentioned Below An aqueous solution of 30 g of inactive gelatin and 6 g of potassium bromide as dissolved in one liter of distilled water was stirred at 75° C., to which 35 cc of an aqueous solution of 5.0 g of silver nitrate and 35 cc of an aqueous solution containing 3.2 g of potassium bromide and 0.80 g of potassium iodide were added each at a flow rate of 70 cc/min over a period of 30 seconds still with stirring. The pAg value of this solution was increased to 10 and this was ripened for 30 minutes to prepare a seed emulsion.

A determined amount of an aqueous solution as prepared by dissolving 145 g of silver nitrate in one liter of water and the same molar amount of an aqueous solution containing a mixture of potassium bromide and potassium iodide were added to the seed emulsion each at a constant flow rate, under pre-determined temperature and pAg conditions, to prepare a tabular core emulsion.

The remaining amount of the aqueous silver nitrate solution and the same molar amount of an aqueous solution containing a mixture of potassium bromide and potassium iodide, the ratio of the bromide to the iodide being different from that in the aqueous solution previously used in preparing the core emulsion were added to the core emulsion each at a constant flow rate under predetermined temperature and pAg values so as to cover the core grains in the seed emulsion to prepare an emulsion comprising tabular core/shell silver iodobromide grains.

The emulsion was then de-salted by a conventional flocculation method and subjected to optimum chemical sensitization with sodium thiosulfate, chloroauric acid and potassium thiocyanate at 62° C. to have an optimum 1/100 second sensitivity.

Accordingly, emulsion (H) was obtained, which contained tabular grains in a proportion of 85% or more of the total projected area of all the grains therein. The grains in the emulsion had a mean sphere-corresponding diameter of 1.2 μm, a mean aspect ratio of 5.5 and a silver iodide content of 7.6 mol %.

In the same manner as in preparation of emulsion (H), other emulsions (I) to (K) were prepared except that the grain size of the grains constituting the emulsions was varied. The emulsions thus formed are shown in Table 4 below, along with comparative silver halide emulsions.

Emulsions (A) to (F) were prepared according to the procedure described, for example, in Research Disclosure disclosed above, G. E. Daffin, *Photographic Emulsion Chemistry,* V. L. Zelikman, *Making and Coating of Photographic Emulsion,* etc. Emulsion (G) is a light-insensitive fine grain silver halide, which was prepared in the same manner as in a conventional light-sensitive silver halide, and not chemically sensitized and not spectrally sensitized.

Using the emulsions, photographic material Sample Nos. 201 to 216 were prepared.

TABLE 4

| Emulsion | Mean AgI Content (%) | Mean Grain Size (μm) | Fluctuation Coefficient relating to Grain Size (%) | Ratio of Diameter/–Thickness |
|---|---|---|---|---|
| A | 4.0 | 0.45 | 27 | 1 |
| B | 8.9 | 0.70 | 14 | 1 |
| C | 2.0 | 0.55 | 25 | 2 |
| D | 9.0 | 0.65 | 25 | 2.5 |
| E | 9.0 | 0.85 | 23 | 2 |
| F | 9.0 | 1.25 | 25 | 2 |
| G | 1.0 | 0.07 | 15 | 1 |
| H | 7.6 | 1.20 | 28 | 7 |
| I | 7.6 | 0.70 | 25 | 7 |
| J | 3.0 | 0.55 | 25 | 6 |
| K | 7.6 | 0.95 | 28 | 7 |

Plural layers each having the composition mentioned below were coated on a subbing layer-coated cellulose triacetate support, to prepare a multi-layer color photographic material Sample 201.

Compositions of Photographic Layers

Essential components constituting the photographic layers are grouped as follows:

ExC: Cyan Coupler

UV: Ultraviolet Absorbent

ExM: Magenta Coupler

HBS: High Boiling Point Organic Solvent

ExY: Yellow Coupler

H: Gelatin Hardening Agent

ExS: Sensitizing Dye

The number for each component indicates the amount coated in units of g/m$^2$. The amount of silver halide coated is represented as the amount of silver therein coated. The amount of sensitizing dye coated is represented by way of a molar unit to per mol of silver halide in the same layer.

| Formation of Sample 201: | |
|---|---|
| First Layer: Anti-halation Layer | |
| Black Colloidal Silver | 0.18 as Ag |
| Gelatin | 1.40 |
| ExM-1 | 0.18 |
| ExF-1 | $2.0 \times 10^{-3}$ |
| HBS-1 | 0.20 |
| Second Layer: Interlayer | |
| Emulsion G | 0.065 as Ag |
| 2,5-Di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| Third Layer: Low-sensitivity Red-sensitive Emulsion Layer | |
| Emulsion A | 0.25 as Ag |
| Emulsion B | 0.25 as Ag |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |

-continued

| Formation of Sample 201: | |
|---|---|
| ExC-4 | 0.10 |
| ExC-5 | 0.020 |
| ExC-7 | 0.0050 |
| ExC-8 | 0.010 |
| Cpd-2 | 0.025 |
| HBS-1 | 0.10 |
| Gelatin | 0.87 |
| Fourth Layer: Middle-sensitivity Red-sensitive Emulsion Layer | |
| Emulsion D | 0.70 as Ag |
| ExS-1 | $3.5 \times 10^{-4}$ |
| EXS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.025 |
| ExC-7 | 0.0010 |
| ExC-8 | 0.0070 |
| Cpd-2 | 0.023 |
| HBS-1 | 0.10 |
| Gelatin | 0.75 |
| Fifth Layer: High-sensitivity Red-sensitive Emulsion Layer | |
| Emulsion E | 1.40 as Ag |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.12 |
| ExC-3 | 0.045 |
| ExC-6 | 0.020 |
| ExC-8 | 0.025 |
| Cpd-2 | 0.050 |
| HBS-1 | 0.22 |
| HBS-2 | 0.10 |
| Gelatin | 1.20 |
| Sixth Layer: Interlayer | |
| Cpd-1 | 0.10 |
| HBS-1 | 0.50 |
| Gelatin | 1.10 |
| Seventh Layer: Low-sensitivity Green-sensitive Emulsion Layer | |
| Emulsion C | 0.35 as Ag |
| ExS-4 | $3.0 \times 10^{-5}$ |
| ExS-5 | $2.1 \times 10^{-4}$ |
| ExC-6 | $8.0 \times 10^{-4}$ |
| ExM-1 | 0.010 |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| Eighth Layer: Middle-sensitivity Green-sensitive Emulsion Layer | |
| Emulsion D | 0.80 as Ag |
| ExS-4 | $3.2 \times 10^{-5}$ |
| ExS-5 | $2.2 \times 10^{-4}$ |
| ExS-6 | $8.4 \times 10^{-4}$ |
| ExM-2 | 0.13 |
| ExM-3 | 0.030 |
| ExY-1 | 0.018 |
| HBS-1 | 0.16 |
| HBS-3 | $8.0 \times 10^{-3}$ |
| Gelatin | 0.90 |
| Ninth Layer: High-sensitivity Green-sensitive Emulsion Layer | |
| Emulsion E | 1.25 as Ag |
| ExS-4 | $3.7 \times 10^{-5}$ |

-continued

| Formation of Sample 201: | |
|---|---|
| ExS-5 | $8.1 \times 10^{-5}$ |
| ExS-6 | $3.2 \times 10^{-4}$ |
| ExC-1 | 0.010 |
| ExM-1 | 0.030 |
| ExM-4 | 0.040 |
| ExM-5 | 0.019 |
| Cpd-3 | 0.040 |
| HBS-1 | 0.25 |
| HBS-2 | 0.10 |
| Gelatin | 1.44 |
| Tenth Layer: Yellow Filter Layer | |
| Yellow Colloidal Silver | 0.030 as Ag |
| Cpd-1 | 0.16 |
| HBS-1 | 0.60 |
| Gelatin | 0.60 |
| Eleventh Layer: Low-sensitivity Blue-sensitive Emulsion Layer | |
| Emulsion C | 0.18 as Ag |
| ExS-7 | $8.6 \times 10^{-4}$ |
| ExY-1 | 0.020 |
| ExY-2 | 0.22 |
| ExY-3 | 0.50 |
| ExY-4 | 0.020 |
| HBS-1 | 0.28 |
| Gelatin | 1.10 |
| Twelfth Layer: Middle-sensitivity Blue-sensitive Emulsion Layer | |
| Emulsion D | 0.40 as Ag |
| ExS-7 | $7.4 \times 10^{-4}$ |
| ExC-7 | $7.0 \times 10^{-3}$ |
| ExY-2 | 0.050 |
| ExY-3 | 0.10 |
| HBS-1 | 0.050 |

-continued

| Formation of Sample 201: | |
|---|---|
| Gelatin | 0.78 |
| Thirteenth Layer: High-sensitivity Blue-sensitive Emulsion Layer | |
| Emulsion F | 1.00 as Ag |
| ExS-7 | $4.0 \times 10^{-4}$ |
| ExY-2 | 0.10 |
| ExY-3 | 0.10 |
| HBS-1 | 0.070 |
| Gelatin | 0.86 |
| Fourteenth Layer: First Protective Layer | |
| Emulsion G | 0.20 as Ag |
| UV-4 | 0.11 |
| UV-5 | 0.17 |
| HBS-1 | $5.0 \times 10^{-2}$ |
| Gelatin | 1.00 |
| Fifteenth Layer: Second Protective Layer | |
| H-1 | 0.40 |
| B-1 (diameter 1.7 μm) | $5.0 \times 10^{-2}$ |
| B-2 (diameter 1.7 μm) | 0.10 |
| B-3 | 0.10 |
| S-1 | 0.20 |
| Gelatin | 1.20 |

In addition, the respective layers contained any of W-1 through W-3, B-4 through B-6, F-1 through F-17, and iron salt, lead salt, gold salt, platinum salt, iridium salt and rhodium salt, so as to have improved storability, processability, pressure resistance, fungicidal and bactericidal properties, antistatic properties and coatability.

Structural formulae of the compounds used are shown below.

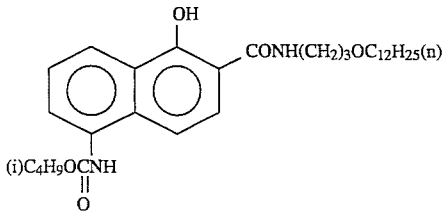

ExC-1

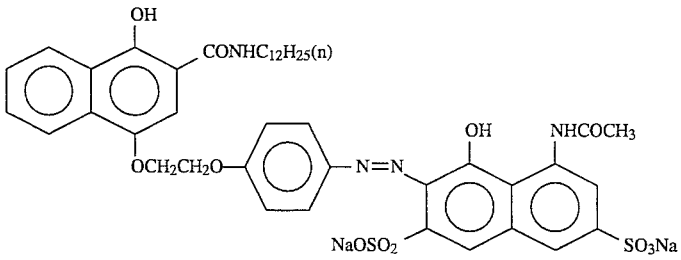

ExC-2

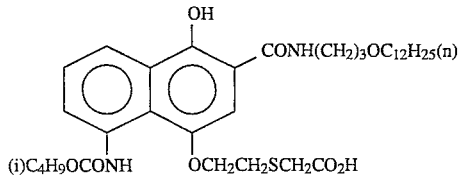

ExC-3

-continued
ExC-4
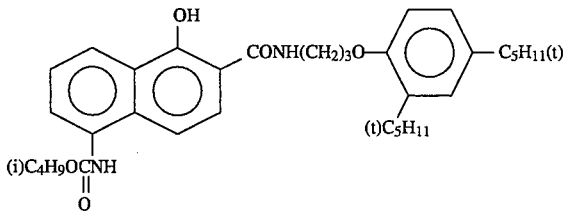
ExC-5
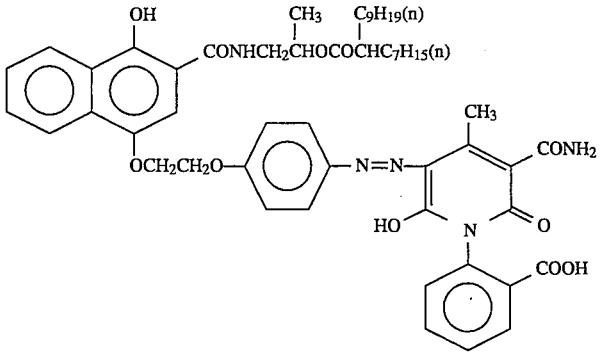
ExC-6
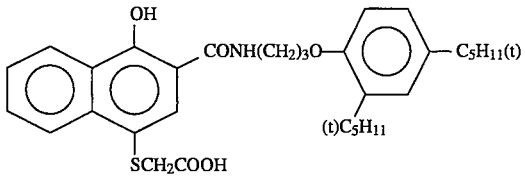
ExC-7
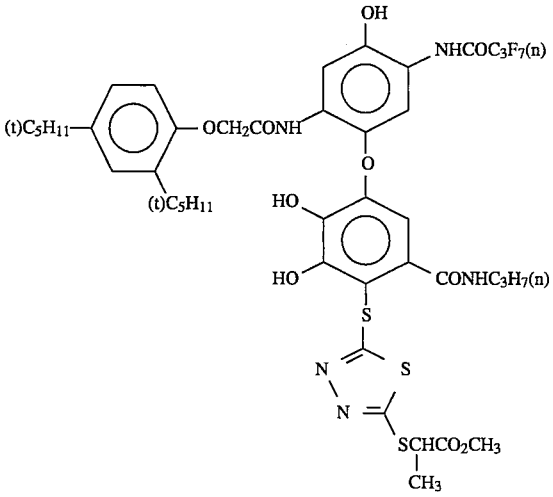
ExC-8
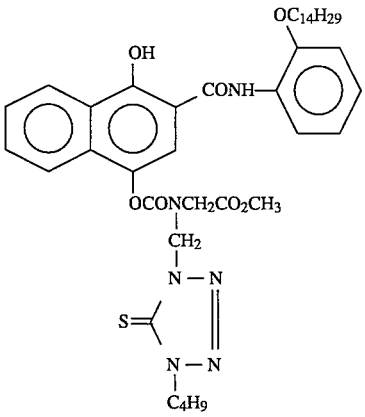

-continued
ExM-1
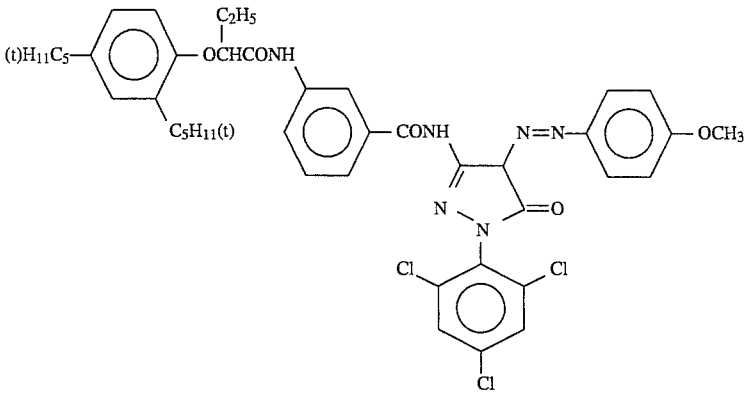
ExM-2
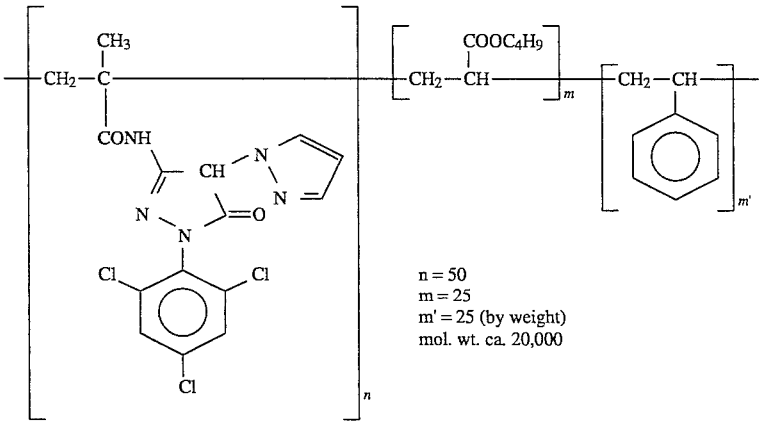
ExM-3
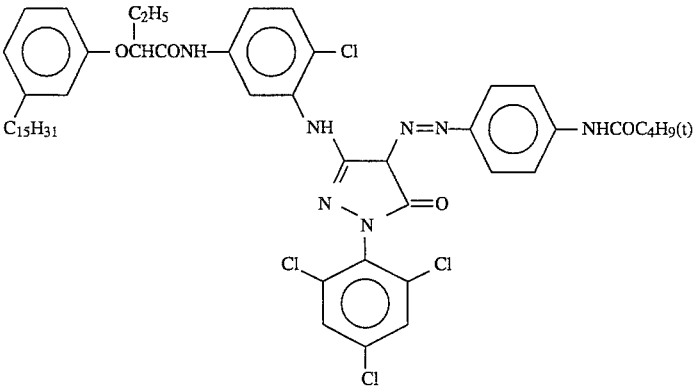
ExM-4
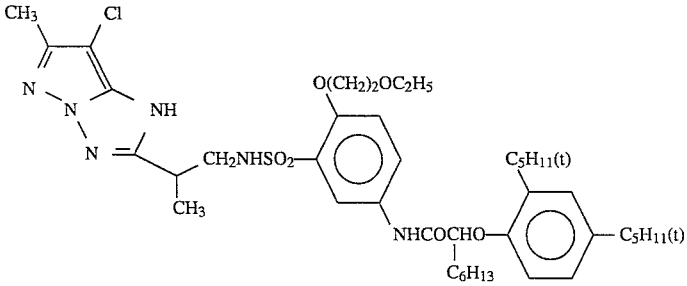

-continued
ExM-5
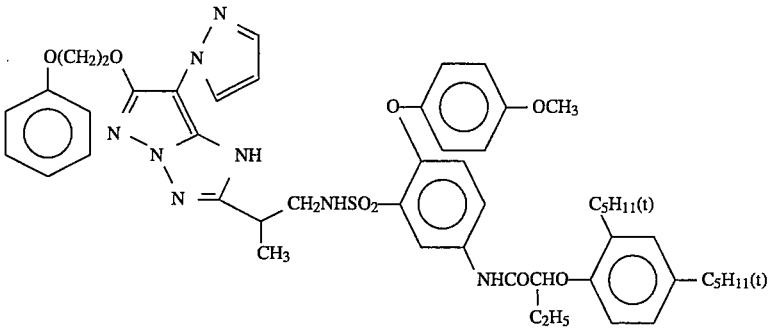
ExY-1
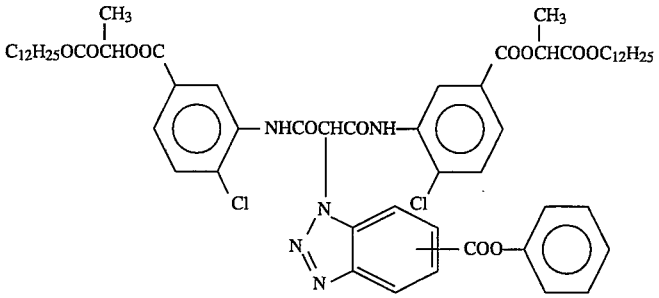
ExY-2
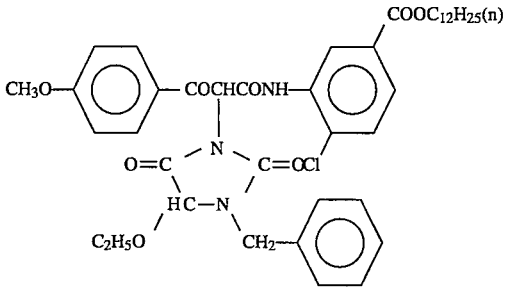
ExY-3
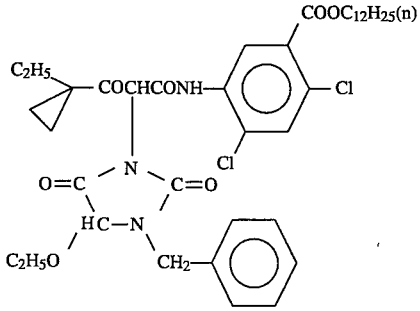
ExY-4
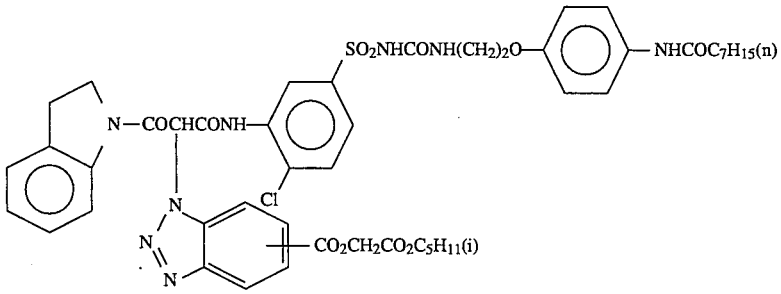

-continued
ExF-1
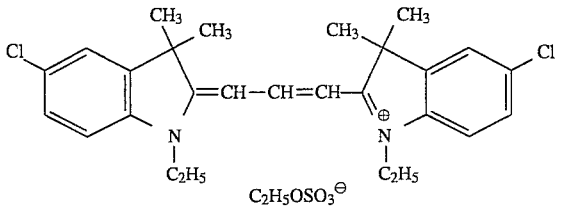
Cpd-1
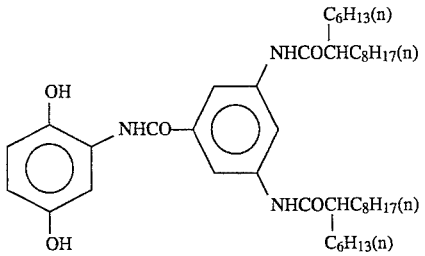
Cpd-2
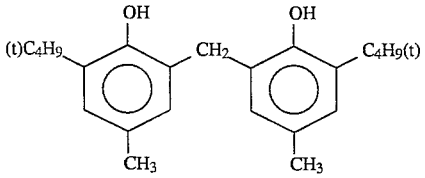
Cpd-3
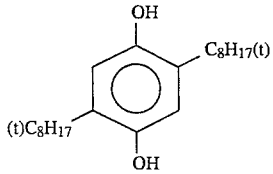
UV-1
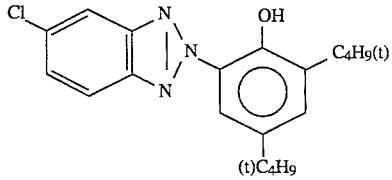
UV-2
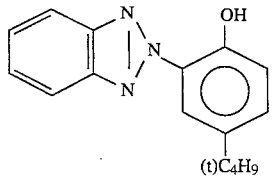
UV-3
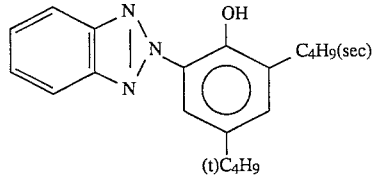
UV-4
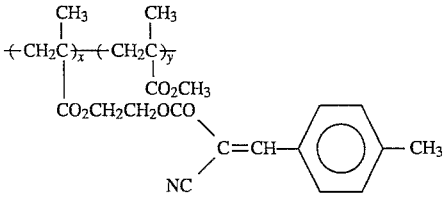
x:y = 70:30 (wt %)

-continued
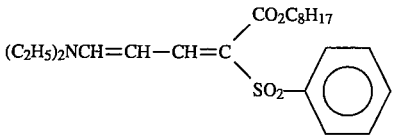
UV-5
Tricresyl Phosphate HBS-1
Di-n-butyl Phthalate HBS-2
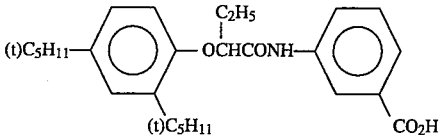
HBS-3
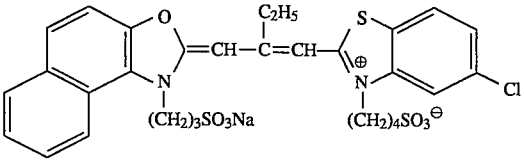
ExS-1
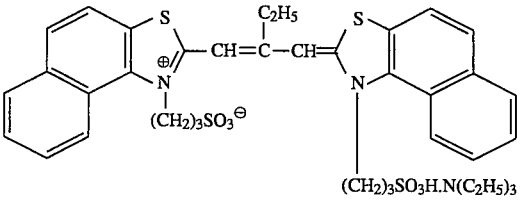
ExS-2
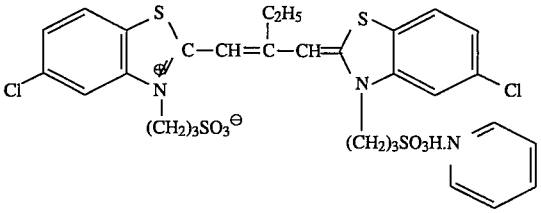
ExS-3
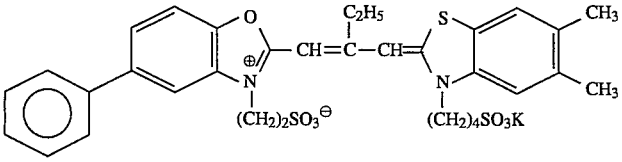
ExS-4
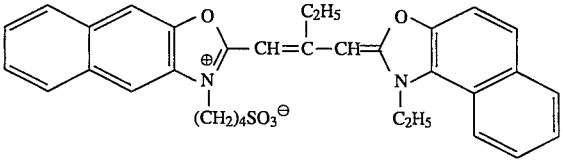
ExS-5
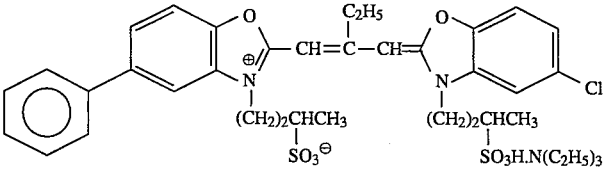
ExS-6
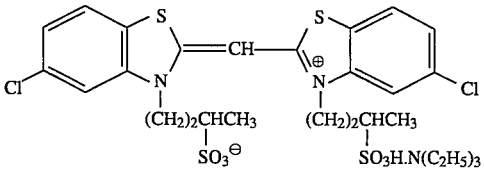
ExS-7

-continued
S-1
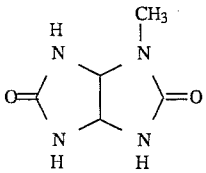
H-1
$CH_2{=}CH{-}SO_2{-}CH_2{-}CONH{-}CH_2$
$CH_2{=}CH{-}SO_2{-}CH_2{-}CONH{-}CH_2$
B-1
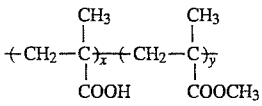
x/y = 10/90 (by weight)
B-2
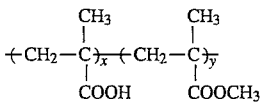
x/y = 40/60 (by weight)
B-3
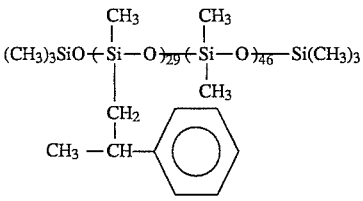
x/y = 29/46 (by weight)
B-4
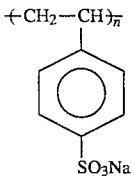
(molecular weight: about 1,000,000)
B-5
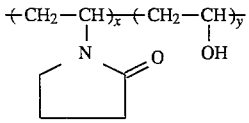
x/y = 70/30 (by weight)
B-6
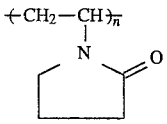
(mol. wt. about 10,000)
W-1
$C_8F_{17}SO_2NHCH_2CH_2CH_2OCH_2CH_2\overset{\oplus}{N}(CH_3)_3$
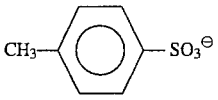
W-2
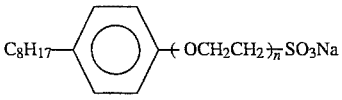
n = 2~4
W-3
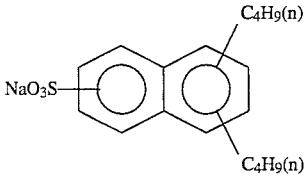

-continued
F-1
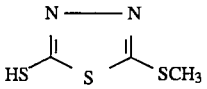
F-2
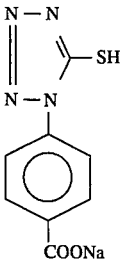
F-3
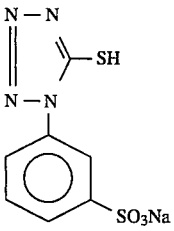
F-4
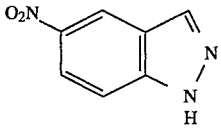
F-5
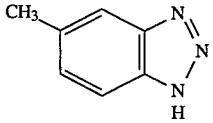
F-6
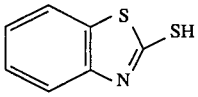
F-7
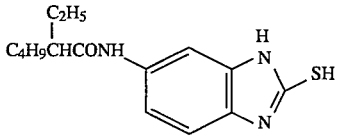
F-8
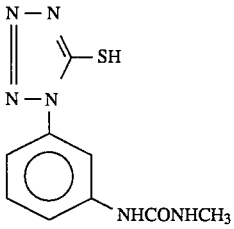
F-9
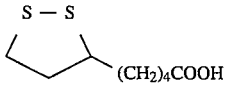
F-10
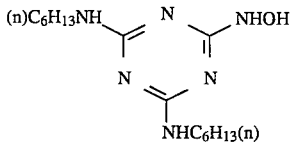

-continued

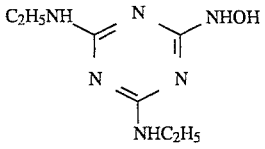

F-11

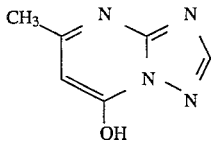

F-12

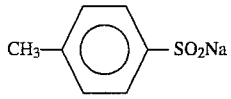

F-13

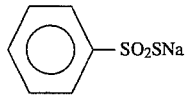

F-14

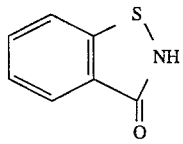

F-15

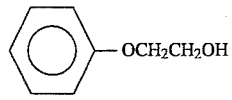

F-16

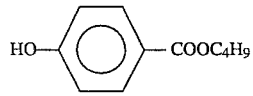

F-17

Formation of Sample No. 202

Sample No. 202 was prepared in the same manner as in preparation of Sample No. 201, except that the emulsion of the eleventh layer was replaced by the emulsion (H), the emulsion of the twelfth layer by the emulsion (I), and the emulsion of the thirteenth layer by the emulsion (J).

Formation of Sample No. 203

Sample No. 203 was prepared in the same manner as in preparation of Sample No. 201, except that the colored coupler Compound (2) of the present invention was added to the eleventh to thirteenth layers in an amount of 25 mg/m$^2$ as a whole. Regarding the share of the compound in the individual layers, the eleventh layer contained 12 mg/m$^2$ of Compound (2), the twelfth layer contained 8 mg/m$^2$ of the same and the thirteenth layer contained 5 mg/m$^2$ of the same.

Formation of Sample No. 204

Sample No. 204 was prepared in the same manner as in preparation of Sample No. 201, except that the eleventh layer contained the emulsion (J) of the present invention, the twelfth layer contained the emulsion (J) of the present invention and the thirteenth layer contained the emulsion (H) of the present invention, all along with the colored coupler Compound (2) of the present invention. Regarding the relative amount of Compound (2) in the individual layers, the eleventh layer contained 48%, the twelfth layer contained 32% and the thirteenth layer contained 20%. The same relative proportions apply to the relative amount of the colored coupler in the plural layers of the following Sample Nos. 205 to 216.

Formation of Samples Nos. 205 to 216

Samples Nos. 205 to 216 were prepared in the same manner as in Example 1, except that the colored coupler as indicated in Table 5 was added to the layers indicated in Table 5 and that the silver halide emulsions as indicated in Table 5 were employed.

The samples thus prepared were subjected to the same tests as those in Example 1. Precisely, Sample Nos. 201 to 206, 215 and 216 were subjected to uniform green exposure followed by blue-imagewise exposure, and the exposed samples were processed in the manner described below. The color turbidity of each of the processed samples is shown in Table 5, which was obtained by subtracting the magenta density in the yellow-fogged density area from the magenta density at the point having the yellow-fogged density plus 0.8.

Sample Nos. 201 and 207 to 210 were subjected to uniform red exposure followed by blue-imagewise exposure, and the exposed samples were processed in the manner mentioned below. The color turbidity of each of the processed samples is shown in Table 5, which was obtained by subtracting the cyan density in the yellow-fogged density area from the cyan density at the point having the yellow-fogged density plus 0.8.

Samples Nos. 201 and 211 to 216 were subjected to uniform red exposure and green-imagewise exposure, and the exposed samples were processed in the manner mentioned below. The color turbidity of each of the processed samples is shown in Table 5, which was obtained by subtracting the cyan density in the magenta-fogged density area from the cyan density at the point having the magenta-fogged density plus 0.8.

In order to examine the sharpness of these samples, all the samples were subjected to pattern-wise white exposure for determination of the MTF values. The exposed samples were then subjected to color development, and the MTF values of the individual colors (R, G, B) were obtained.

All the samples, Nos. 201 to 216, were subjected to imagewise white exposure and then subjected to color development in the manner mentioned below. By measurement of the densities of the individual colors (R, G, B), the sensitometry curves were obtained. The strios used for sensitometry were stored in an atmosphere having a temperature of 55° C. and a relative humidity of 65% for 8 weeks and then again subjected to sensitometrical determination to obtain the individual sensitometry curves. From them, the variation or difference in the density between the fogged area and the area having the fog density plus 1.0 was obtained. The difference indicates the color image stability of each sample, which is shown in Table 6 below.

TABLE 5

| Sample | Colored Coupler | | | Silver Halide Emulsion | Color Turbidity |
|---|---|---|---|---|---|
| | Compound | Layers | Amount (mg/m$^2$) | | |
| 201 (comparative sample) | — | — | — | same as No. 201 | 0.06(*1)<br>0.03(*2)<br>0.05(*3) |
| 202 (comparative sample) | — | — | — | J, I, H in 11th to 13th layers | 0.06 |
| 203 (comparative sample) | (2) | 11th to 13th layers | 25 as a whole | same as No. 201 | 0.03 |
| 204 (sample of the invention) | (2) | 11th to 13th layers | 25 as a whole | J, I, H in 11th to 13th layers | 0.01 |
| 205 (sample of the invention) | (3) | 11th to 13th layers | 23 as a whole | J, I, H in 11th to 13th layers | 0.02 |
| 206 (sample of the invention) | (31) | 11th to 13th layers | 21 as a whole | J, I, H in 11th to 13th layers | 0.01 |
| 207 (comparative sample) | (10) | 11th to 13th layers | 23 as a whole | same as No. 201 | 0.00 |
| 208 (sample of the invention) | (10) | 11th to 13th layers | 23 as a whole | J, I, H in 11th to 13th layers | −0.01 |
| 209 (comparative sample) | (11) | 11th to 13th layers | 21 as a whole | same as No. 201 | 0.01 |
| 210 (sample of the invention) | (11) | 11th to 13th layers | 21 as a whole | J, I, H in 11th to 13th layers | 0.00 |
| 211 (comparative sample) | — | — | — | J, I, K in 7th to 9th layers | 0.05 |
| 212 (comparative sample) | (21) | 7th to 9th layers | 24 as a whole | same as No. 201 | 0.02 |
| 213 (sample of the invention) | (21) | 7th to 9th layers | 24 as a whole | J, I, K in 7th to 9th layers | −0.01 |
| 214 (sample of the invention) | (22) | 7th to 9th layers | 22 as a whole | J, I, K in 7th to 9th layers | 0.00 |
| 215 (sample of the invention) | (2) | 11th to 13th layers | 25 as a whole | J, I, H in 11th to 13th layers | 0.01(*1) |
| | (21) | 7th to 9th layers | 24 as a whole | J, I, K in 7th to 9th layers | 0.00(*3) |
| 216 (sample of the invention) | (31) | 11th to 13th layers | 21 as a whole | J, I, H in 11th to 13th layers | 0.01(*1) |
| | (22) | 7th to 9th layers | 22 as a whole | J, I, K in 7th to 9th layers | 0.00(*3) |

(*1) Color turbidity after uniform green exposure followed by blue-imagewise exposure
(*2) Color turbidity after uniform red exposure followed by blue-imagewise exposure
(*3) Color turbidity after uniform red exposure followed by green-imagewise exposure

TABLE 6

| Sample | MTF Values (20 cycles/mm) | | | Color Image Storage Stability | | |
|---|---|---|---|---|---|---|
| | Yellow | Magenta | Cyan | Yellow | Magenta | Cyan |
| 201 (comparative sample) | 0.85 | 0.77 | 0.55 | +0.02/−0.11 | +0.03/−0.09 | ±0/±0 |
| 202 (comparative sample) | 0.85 | 0.79 | 0.57 | +0.02/−0.10 | +0.03/+0.10 | ±0/±0 |
| 203 (comparative sample) | 0.85 | 0.79 | 0.55 | +0.02/−0.09 | +0.02/+0.07 | ±0/±0 |
| 204 (sample of the invention) | 0.85 | 0.83 | 0.58 | +0.02/−0.08 | +0.02/+0.06 | ±0/±0 |
| 205 (sample of the invention) | 0.85 | 0.82 | 0.58 | +0.01/−0.07 | +0.02/+0.06 | ±0/±0 |
| 206 (sample of the invention) | 0.85 | 0.82 | 0.57 | +0.01/−0.07 | +0.02/+0.06 | ±0/±0 |
| 207 (comparative sample) | 0.85 | 0.78 | 0.57 | +0.01/−0.07 | +0.01/+0.06 | ±0/±0.01 |

TABLE 6-continued

| Sample | MTF Values (20 cycles/mm) | | | Color Image Storage Stability | | |
|---|---|---|---|---|---|---|
| | Yellow | Magenta | Cyan | Yellow | Magenta | Cyan |
| 208 (sample of the invention) | 0.85 | 0.79 | 0.60 | +0.01/−0.07 | +0.01/+0.06 | ±0/±0.01 |
| 209 (comparative sample) | 0.85 | 0.78 | 0.57 | +0.02/−0.08 | +0.01/+0.07 | ±0/±0 |
| 210 (sample of the invention) | 0.85 | 0.78 | 0.61 | +0.02/−0.07 | +0.01/+0.06 | ±0/±0 |
| 211 (comparative sample) | 0.84 | 0.77 | 0.57 | +0.02/−0.10 | +0.03/+0.10 | ±0/±0 |
| 212 (comparative sample) | 0.84 | 0.77 | 0.57 | +0.02/−0.08 | +0.02/+0.08 | +0/±0 |
| 213 (sample of the invention) | 0.84 | 0.77 | 0.61 | +0.01/−0.07 | +0.01/+0.07 | ±0/±0.01 |
| 214 (sample of the invention) | 0.85 | 0.78 | 0.60 | +0.01/−0.07 | +0.01/+0.06 | ±0/±0.01 |
| 215 (sample of the invention) | 0.85 | 0.83 | 0.61 | +0.01/−0.07 | +0.01/+0.06 | ±0/±0.01 |
| 216 (sample of the invention) | 0.85 | 0.83 | 0.60 | +0.01/−0.07 | +0.01/+0.06 | ±0/±0 |

The process for color development of the exposed samples as employed in the present example was as follows:

| Step | Time | Temp. (°C.) | Amount of Replenisher | Tank Capacity |
|---|---|---|---|---|
| Color Development | 3 min 15 sec | 38 | 22 ml | 20 liters |
| Bleaching | 3 min 00 sec | 38 | 25 ml | 40 liters |
| Rinsing | 30 sec | 24 | 1200 ml | 20 liters |
| Fixation | 3 min 00 sec | 38 | 25 ml | 30 liters |
| Rinsing (1) | 30 sec | 24 | counter-current cascade piping system from (2) to (1) | 10 liters |
| Rinsing (2) | 30 sec | 24 | 1200 ml | 10 liters |
| Stabilization | 30 sec | 38 | 25 ml | 10 liters |
| Drying | 4 min 20 sec | 55 | | |

Amount of replenisher was per meter of 35 mm-wide sample.

The compositions of the processing solutions used above are mentioned below.

| | Tank Solution | Replenisher |
|---|---|---|
| Color Developer: | | |
| Diethylenetriaminepentaacetic Acid | 1.0 g | 1.1 g |
| 1-Hydroxyethylidene-1,1-diphosphonic Acid | 3.0 g | 3.2 g |
| Sodium Sulfite | 4.0 g | 4.4 g |
| Potassium Carbonate | 30.0 g | 37.0 g |
| Potassium Bromide | 1.4 g | 0.3 g |
| Potassium Iodide | 1.5 mg | — |
| Hydroxylamine Sulfate | 2.4 g | 2.8 g |
| 4-[N-ethyl-N-β-hydroxyethylamino]-2-methylaniline Sulfate | 4.5 g | 6.2 g |
| Water to make | 1.0 liter | 1.0 liter |
| pH | 10.05 | 10.15 |
| Bleaching Solution: | | |
| Disodium Ethylenediaminetetraacetato/Fe(III) Tri-hydrate | 100.0 g | 120.0 g |
| Disodium Ethylenediaminetetraacetate | 10.0 g | 11.0 g |
| 3-Mercapto-1,2,4-triazole | 0.08 g | 0.09 g |
| Ammonium Bromide | 140.0 g | 160.0 g |
| Ammonium Nitrate | 30.0 g | 35.0 g |
| Aqueous Ammonia (27%) | 6.5 ml | 35.0 ml |
| Water to make | 1.0 liter | 1.0 liter |
| pH | 6.0 | 5.7 |

-continued

| | Tank Solution | Replenisher |
|---|---|---|
| Fixing Solution: | | |
| Disodium Ethylenediaminetetraacetate | 0.5 g | 0.7 g |
| Ammonium Sulfite | 20.0 g | 22.0 g |
| Ammonium Thiosulfate Aqueous Solution (700 g/liter) | 290.0 ml | 320.0 ml |
| Water to make | 1 liter | 1 liter |
| pH | 6.7 | 7.0 |
| Stabilizer: | | |
| Tank solution and replenisher were same. | | |
| Sodium P-toluenesulfinate | | 0.03 g |
| Polyoxyethylene P-monononylphenyl Ether (mean polymerization degree 10) | | 0.2 g |
| Disodium Ethylenediaminetetraacetate | | 0.05 g |
| 1,2,4-Triazole | | 1.3 g |
| 1,4-Bis(1,2,4-triazol-1-ylmethyl)piperazine | | 0.75 g |
| Water to make | | 1.0 liter |
| pH | | 8.5 |

From the results in Tables 5 and 6 above, it is understood that the samples of the present invention containing both a colored coupler of the present invention and tabular silver halide emulsions of the present invention displayed a synergistic effect which is larger than the additive effect to be obtained by mere additive combination of the comparative samples containing only a colored coupler and those containing only tabular silver halide emulsions, with respect to the color turbidity, sharpness and color image storage stability, like the samples of the present invention as demonstrated in Example 1.

Also in the present example, it is shown that the color images as formed in the samples of the present invention were much improved and that the color reproducibility and the sharpness of them were also improved.

EXAMPLE 3

Sample Nos. 201 to 216 as prepared in Example 2 were exposed and processed in the same manner as in Example 2, except that the process for color development of them was replaced by that mentioned below. From these results, it is understood that the photographic materials of the present invention provide always the same excellent properties as in Example 2 irrespective of the manner of processing them.

Process for Color Development:

| Step | Time | Temp. (°C.) | Amount of Replenisher(*) | Tank Capacity |
|---|---|---|---|---|
| Color Development | 3 min 5 sec | 38.0 | 600 ml | 17 liters |
| Bleaching | 50 sec | 38.0 | 140 ml | 5 liters |
| Bleach-fixation | 50 sec | 38.0 | — | 5 liters |
| Fixation | 50 sec | 38.0 | 420 ml | 5 liters |
| Rinsing | 30 sec | 38.0 | 980 ml | 3.5 liters |
| Stabilization (1) | 20 sec | 38.0 | — | 3 liters |
| Stabilization (2) | 20 sec | 38.0 | 560 ml | 3 liters |
| Drying | 1 min 30 sec | 60 | | |

Amount of replenisher is per $m^2$ of the sample being processed.

The stabilization was effected by a countercurrent cascade piping system from the tank (2) to the tank (1). All the overflow from the rinsing tank was returned back to the fixation bath. The top of the bleaching bath and that of the fixation bath of the automatic developing machine used in the present example were both notched so that all the overflows from the bleaching bath and the fixation bath generated by replenishment to both the bathes were introduced into the bleach-fixation bath for replenishment thereto. The amount of the carryover from the developer bath to the bleaching bath, that of the carryover from the bleaching bath to the bleach-fixation bath, that of the carryover from the bleach-fixation bath to the fixation bath and that of the carryover from the fixation bath to the rinsing bath were 65 ml, 50 ml, 50 ml and 50 ml, respectively, per $m^2$ of the sample being processed.. The cross-over time between the adjacent bathes was all 6 seconds, and the time was included in the processing time in the previous bath.

The compositions of the processing solutions used above are mentioned below.

| | Tank Solution | Replenisher |
|---|---|---|
| Color Developer: | | |
| Diethylenetriamine-pentaacetic Acid | 2.0 g | 2.0 g |
| 1-Hydroxyethylidene-1,1-diphosphonic Acid | 3.3 g | 3.3 g |
| Sodium Sulfite | 3.9 g | 5.1 g |
| Potassium Carbonate | 37.5 g | 39.0 g |
| Potassium Bromide | 1.4 g | 0.4 g |
| Potassium Iodide | 1.3 mg | — |
| Hydroxylamine Sulfate | 2.4 g | 3.3 g |
| 2-Methyl-4-[N-ethyl-N-(β-hydroxyethyl) amino]aniline Sulfate | 4.5 g | 6.0 g |
| Water to make | 1.0 liter | 1.0 liter |
| pH | 10.05 | 10.15 |
| Bleaching Solution: | | |
| Ammonium 1,3-Diaminopropanetetraacetate/Fe(III) Monohydrate | 130 g | 195 g |
| Ammonium Bromide | 70 g | 105 g |
| Ammonium Nitrate | 14 g | 21 g |
| Hydroxyacetic Acid | 50 g | 75 g |
| Acetic Acid | 40 g | 60 g |
| Water to make | 1.0 liter | 1.0 liter |
| pH (adjusted with aqueous ammonia) | 4.4 | 4.4 |

Bleach-fixation Tank Solution

This is a mixture of 15/85 (by volume) of the above-mentioned bleaching tank solution and the following fixation tank solution. This had DH of 7.0.

| | Tank Solution | Replenisher |
|---|---|---|
| Fixing Solution: | | |
| Ammonium Sulfite | 19 g | 57 g |
| Ammonium Thiosulfate Aqueous Solution (700 g/liter) | 280 ml | 840 ml |
| Imidazole | 15 g | 45 g |
| Ethylenediaminetetraacetic Acid | 15 g | 45 g |
| Water to make | 1.0 liter | 1.0 liter |
| pH (adjusted with aqueous ammonia and acetic acid) | 7.4 | 7.45 |

Rinsing Water

City water was passed through a mixed bed type column as filled with an H-type strong acidic cation-exchange resin (Amberlite IR-120B, produced by Rohm & Haas Co.) and an OH-type strong basic anion-exchange resin (Amberlite IRA-400, produced by Rhom & Haas Co.) so that both the calcium ion concentration and the magnesium ion concentration in the water were reduced to 3 mg/liter, individually. Next, 20 ml/liter of sodium dichloroisocyanurate and 150 mg/liter of sodium sulfate were added to the resulting water, which had a pH value falling within the range of from 6.5 to 7.5. This was used as the rinsing water.

| Stabilizing Solution: | |
|---|---|
| Tank solution and replenisher were same. | |
| Sodium P-toluenesulfonate | 0.03 g |
| Polyoxyethylene P-monononylphenyl Ether (mean polymerization degree 10) | 0.2 g |
| Disodium Ethylenediaminetetraacetate | 0.05 g |
| 1,2,4-Triazole | 1.3 g |
| 1,4-Bis(1,2,4-triazol-1-ylmethyl)piperazine | 0.75 g |
| Water to make | 1.0 liter |
| pH | 8.5 |

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having at least one cyan dye-forming coupler-containing red-sensitive silver halide emulsion layer, at least one magenta dye-forming coupler-containing green-sensitive silver halide emulsion layer and at least one yellow dye-forming coupler-containing blue-sensitive silver halide emulsion layer on a support, in which the green-sensitive silver halide emulsion layer contains a colored coupler of the following general formula (2) and contains an emulsion of tabular silver halide grains having a mean aspect ratio of 3.0 or more:

$$A_2—(L)N—DY_2 \quad (2)$$

where $A_2$ represents a magenta coupler group;

L represents a timing group;

n represents 0 or 1; and

DY2 represents a cyan dye group.

2. A silver halide color photographic material having at least one cyan dye-forming coupler-containing red-sensitive silver halide emulsion layer, at least one magenta dye-forming coupler-containing green-sensitive silver halide emulsion layer and at least one yellow dye-forming coupler-containing blue-sensitive silver halide emulsion layer on a support, in which the blue-sensitive silver halide emulsion layer and/or the green-sensitive silver halide emulsion layer contain (s) a colored coupler of the following general formula (3) and contain(s) an emulsion of tabular silver halide grains having a mean aspect ratio of 3.0 or more:

$$A_3—(L)n—DY_1 \quad (3)$$

where $A_3$ represents a coupler group which substantially does not leave a dye in the photographic material;

L represents a timing group;

n represents 0 or 1; and $DY_1$ represents a magenta dye group or a cyan dye group.

3. The silver halide color photographic material as claimed in claim 1, which contains a colored coupler of the following general formula (3) in the green-sensitive layer.

$$A_3—(L)N—DY_1 \quad (3)$$

where $A_3$ represents a coupler group which substantially does not leave a dye in the photographic material;

L represents a timing group;

n represents 0 or 1; and $DY_1$ represents a magenta dye group or a cyan dye group.

4. A silver halide color photographic material having at least one cyan dye-forming coupler-containing red-sensitive silver halide emulsion layer, at least one magenta dye-forming coupler-containing green-sensitive silver halide emulsion layer and at least one yellow dye-forming coupler-containing blue-sensitive silver halide emulsion layer on a support, in which the blue-sensitive silver halide emulsion layer contains a colored coupler of the following general formula (1) and contains an emulsion of tabular silver halide grains having a mean aspect ratio of 3.0 or more and wherein the green-sensitive silver halide emulsion layer contains a colored coupler of the following general formula (2):

$$A_1—(L)n—DY_1 \quad (1)$$

where $A_1$ represents a yellow coupler group;

L represents a timing group;

n represents 0 or 1; and

DY represents a magenta dye group or a cyan dye group;

$$A_2—(L)n—DY_2 \quad (2)$$

where $A_2$ represents a magenta coupler group;

L represents a timing group;

n represents 0 or 1; and

DY2 represents a cyan dye group.

5. A silver halide color photographic material having at least one cyan dye-forming coupler-containing red-sensitive silver halide emulsion layer, at least one magenta dye-forming coupler-containing green-sensitive silver halide emulsion layer and at least one yellow dye-forming coupler-containing blue-sensitive silver halide emulsion layer on a support, in which the blue-sensitive silver halide emulsion layer contains a colored coupler of the following general formula (1) and contains an emulsion of tabular silver halide grains having a mean aspect ratio of 3.0 or more and wherein the blue-sensitive silver halide emulsion layer contains a colored coupler of the following general formula (3):

$$A_1—(L)n—DY_1 \quad (1)$$

where $A_1$ represents a yellow coupler group;

L represents a timing group;

n represents 0 or 1; and $DY_1$ represents a magenta dye group or a cyan dye group;

$$A_3—(L)n—DY_1 \quad (3)$$

where $A_3$ represents a coupler group which substantially does not leave a dye in the photographic material;

L represents a timing group;

n represents 0 or 1; and $DY_1$ represents a magenta dye group or a cyan dye group.

* * * * *